US007325352B2

(12) United States Patent
Matthews et al.

(10) Patent No.: US 7,325,352 B2
(45) Date of Patent: Feb. 5, 2008

(54) ACCESSORY DEVICES FOR FIREARMS

(75) Inventors: John W. Matthews, Newport Beach, CA (US); Paul Y. Kim, Irvine, CA (US)

(73) Assignee: Surefire, LLC, Fountain Valley, CA (US)

( * ) Notice: Subject to any disclaimer, the term of this patent is extended or adjusted under 35 U.S.C. 154(b) by 601 days.

(21) Appl. No.: 10/877,600

(22) Filed: Jun. 24, 2004

(65) Prior Publication Data

US 2005/0217162 A1 Oct. 6, 2005

Related U.S. Application Data

(63) Continuation-in-part of application No. 10/819,535, filed on Apr. 6, 2004, now Pat. No. 7,117,624.

(51) Int. Cl.
*F41C 23/00* (2006.01)

(52) U.S. Cl. ..... 42/85; 42/90; 42/124; 42/113; 89/200; 362/110

(58) Field of Classification Search ..... 42/113, 42/114, 115, 117, 146, 124, 90, 85; 89/200; 362/110

See application file for complete search history.

(56) References Cited

U.S. PATENT DOCUMENTS

| | | | |
|---|---|---|---|
| 0,689,547 | A | 12/1901 | James |
| 0,894,306 | A | 7/1908 | Wright |
| 0,933,095 | A | 9/1909 | Mosteller |
| 0,957,299 | A | 5/1910 | Barnes |
| 0,958,332 | A | 5/1910 | Snyder |
| 0,982,280 | A | 1/1911 | Lewis |
| 1,120,769 | A | 12/1914 | Villarejo |
| 1,149,705 | A | 8/1915 | Ward |
| 1,215,171 | A | 2/1917 | Lewis |
| 1,222,778 | A | 4/1917 | McCleary |
| 1,262,270 | A | 4/1918 | Schmidt et al. |
| 1,263,667 | A | 4/1918 | Henderson et al. |
| 1,338,239 | A | 4/1920 | Matys |
| 1,427,042 | A | 8/1922 | Wetmore |
| 1,452,651 | A | 4/1923 | Norrlin |
| 1,826,004 | A | 10/1931 | Key |
| 1,865,127 | A | 6/1932 | McKeen |
| 1,877,016 | A | 9/1932 | Munson |
| 1,993,979 | A | 3/1935 | Reed |

(Continued)

FOREIGN PATENT DOCUMENTS

| | | |
|---|---|---|
| AT | 274620 | 12/1968 |

(Continued)

OTHER PUBLICATIONS

United States Department of Defense, Military Standard: Dimensioning of Accessory Mounting Rail for Small Arms Weapons, MIL-STD-1913, Feb. 3, 1995.

(Continued)

*Primary Examiner*—J. Woodrow Eldred
(74) *Attorney, Agent, or Firm*—David Weiss

(57) ABSTRACT

An accessory device for being mounted to a longitudinal rail carried by a firearm and accommodating longitudinal rails of different configurations. A preferred embodiment comprises a light beam generator including a housing, elongate members removably secured to the housing and complementing the rail for enabling the housing to be retainably slid along the rail, a transverse rail latching device removably secured to the housing, and a replaceable ambidextrous tail cap switch.

66 Claims, 10 Drawing Sheets

U.S. PATENT DOCUMENTS

| | | | |
|---|---|---|---|
| 2,017,585 A | 10/1935 | Casey | |
| 2,085,732 A | 7/1937 | Baxter et al. | |
| 2,108,475 A | 2/1938 | Cooper | |
| 2,158,915 A | 5/1939 | Searcy | |
| 2,209,524 A | 7/1940 | Key | |
| 2,236,736 A | 4/1941 | Scott | |
| 2,314,061 A | 3/1943 | Whaley | |
| 2,336,718 A | 12/1943 | Davis | |
| 2,385,649 A | 9/1945 | Prideaux | |
| 2,450,584 A | 10/1948 | Dodge | |
| 2,529,057 A | 11/1950 | Teffault | |
| 2,546,242 A | 3/1951 | Stinson | |
| 2,597,565 A | 5/1952 | Chandler et al. | |
| 2,645,017 A | 7/1953 | Haase | |
| 2,657,303 A | 10/1953 | Dickens | |
| 2,844,710 A | 7/1958 | Zinsser | |
| 2,912,566 A | 11/1959 | Cornett | |
| 3,010,019 A | 11/1961 | Sohst | |
| 3,019,542 A | 2/1962 | Manthos | |
| 3,153,856 A | 10/1964 | Felix | |
| 3,222,022 A | 12/1965 | Akin, Jr. | |
| 3,222,511 A | 12/1965 | Breeding | |
| 3,243,896 A | 4/1966 | Immarco et al. | |
| 3,417,237 A | 12/1968 | Fenton | |
| 3,447,033 A | 5/1969 | Redmond et al. | |
| 3,454,898 A | 7/1969 | Cornstock | |
| 3,509,344 A | 4/1970 | Bouwers | |
| 3,513,581 A | 5/1970 | Slater | |
| 3,562,944 A | 2/1971 | Wagner et al. | |
| 3,633,285 A | 1/1972 | Sensney | |
| 3,656,845 A | 4/1972 | Koch-Bossard et al. | |
| 3,739,167 A | 6/1973 | Avery | |
| 3,742,636 A | 7/1973 | Dealy et al. | |
| 3,782,832 A | 1/1974 | Hacskaylo | |
| 3,787,693 A | 1/1974 | Stone | |
| 3,834,052 A | 9/1974 | Steck, III | |
| 3,867,764 A | 2/1975 | Dunmire et al. | |
| 3,877,166 A | 4/1975 | Ward | |
| 3,898,747 A | 8/1975 | Marshall | |
| 3,938,262 A | 2/1976 | Dye et al. | |
| 3,974,585 A | 8/1976 | Dunham | |
| 3,995,376 A | 12/1976 | Kimble et al. | |
| 4,000,403 A | 12/1976 | Rice | |
| 4,026,054 A | 5/1977 | Snyder | |
| 4,027,159 A | 5/1977 | Bishop | |
| 4,044,486 A | 8/1977 | Van Holten | |
| 4,069,414 A | 1/1978 | Bell | |
| 4,079,534 A | 3/1978 | Snyder | |
| 4,112,300 A | 9/1978 | Hall, Jr. et al. | |
| 4,152,754 A | 5/1979 | deFilippis et al. | |
| 4,161,076 A | 7/1979 | Snyder | |
| 4,168,588 A | 9/1979 | Snyder | |
| 4,172,590 A | 10/1979 | Jarret et al. | |
| 4,212,109 A | 7/1980 | Snyder | |
| 4,266,873 A | 5/1981 | Hacskaylo et al. | |
| 4,281,993 A | 8/1981 | Shaw | |
| 4,291,479 A | 9/1981 | Lough | |
| 4,295,289 A | 10/1981 | Snyder | |
| 4,310,980 A | 1/1982 | Pilkington | |
| 4,313,272 A | 2/1982 | Matthews | |
| 4,313,273 A | 2/1982 | Matthews et al. | |
| 4,315,150 A | 2/1982 | Darringer et al. | |
| 4,383,371 A | 5/1983 | Coffey | |
| 4,417,814 A | 11/1983 | Doliber | |
| 4,418,487 A | 12/1983 | Strahan | |
| 4,446,644 A | 5/1984 | Jimenez et al. | |
| 4,542,447 A | 9/1985 | Quakenbush | |
| 4,554,744 A | 11/1985 | Huckenbeck | |
| 4,561,775 A | 12/1985 | Patrick et al. | |
| 4,570,290 A | 2/1986 | Anderson | |
| 4,571,870 A | 2/1986 | Heideman et al. | |
| 4,580,362 A * | 4/1986 | Stevens | 42/1.01 |
| 4,627,183 A | 12/1986 | Stuckman | |
| 4,658,139 A | 4/1987 | Brennan et al. | |
| 4,665,622 A | 5/1987 | Idan | |
| 4,697,226 A | 9/1987 | Verdin | |
| 4,707,595 A | 11/1987 | Meyers | |
| 4,738,044 A | 4/1988 | Osterhout | |
| 4,777,754 A | 10/1988 | Reynolds, Jr. | |
| 4,779,370 A | 10/1988 | Cormack | |
| 4,799,325 A | 1/1989 | Booze | |
| 4,825,744 A | 5/1989 | Glock | |
| 4,853,529 A | 8/1989 | Meyers | |
| 4,856,218 A | 8/1989 | Reynolds, Jr. | |
| 4,876,815 A | 10/1989 | Terrill | |
| 4,876,816 A | 10/1989 | Triplett | |
| 4,893,546 A | 1/1990 | Glock | |
| 4,894,941 A | 1/1990 | Karow, Jr. | |
| 4,905,396 A | 3/1990 | Bechtel | |
| 4,916,579 A | 4/1990 | Simms | |
| 4,916,713 A | 4/1990 | Gerber | |
| 4,926,576 A | 5/1990 | Maes et al. | |
| 4,934,085 A | 6/1990 | Lough | |
| 4,939,863 A | 7/1990 | Alexander et al. | |
| 4,962,916 A | 10/1990 | Palinkas | |
| 4,991,183 A | 2/1991 | Meyers | |
| 4,993,833 A | 2/1991 | Lorey et al. | |
| RE33,572 E | 4/1991 | Meyers | |
| 5,026,158 A | 6/1991 | Golubic | |
| 5,031,349 A | 7/1991 | Vogel | |
| 5,036,517 A | 7/1991 | Meyers | |
| 5,040,322 A | 8/1991 | Iturrey, Jr. | |
| 5,040,885 A | 8/1991 | Simms | |
| 5,042,048 A | 8/1991 | Meyer | |
| 5,052,801 A | 10/1991 | Downes, Jr. et al. | |
| 5,056,097 A | 10/1991 | Meyers | |
| 5,058,900 A | 10/1991 | Denen | |
| 5,064,988 A | 11/1991 | E'nama et al. | |
| 5,065,988 A | 11/1991 | Wedell | |
| 5,090,805 A | 2/1992 | Stawarz | |
| 5,102,107 A | 4/1992 | Simon et al. | |
| 5,107,612 A | 4/1992 | Bechtel | |
| 5,111,587 A | 5/1992 | Plank | |
| 5,118,186 A | 6/1992 | Schratzenstaller et al. | |
| 5,205,044 A | 4/1993 | DePaoli | |
| 5,221,956 A | 6/1993 | Patterson et al. | |
| 5,249,501 A | 10/1993 | Waldman et al. | |
| 5,272,514 A | 12/1993 | Dor | |
| 5,280,890 A | 1/1994 | Wydra | |
| 5,299,375 A | 4/1994 | Thummel et al. | |
| 5,309,337 A | 5/1994 | Groben | |
| 5,355,608 A | 10/1994 | Teetzel | |
| 5,374,986 A | 12/1994 | Solinsky | |
| 5,400,540 A | 3/1995 | Solinsky et al. | |
| 5,425,299 A | 6/1995 | Teetzel | |
| 5,426,880 A | 6/1995 | Ruger et al. | |
| 5,430,967 A | 7/1995 | Woodman, III et al. | |
| 5,471,777 A | 12/1995 | McDonald | |
| 5,481,819 A | 1/1996 | Teetzel | |
| 5,526,749 A | 6/1996 | Teetzel | |
| 5,555,662 A | 9/1996 | Teetzel | |
| 5,581,898 A | 12/1996 | Thummel | |
| 5,584,137 A | 12/1996 | Teetzel | |
| 5,642,932 A | 7/1997 | Matthews | |
| 5,654,594 A | 8/1997 | Bjornsen, III et al. | |
| 5,669,174 A | 9/1997 | Teetzel | |
| 5,685,105 A | 11/1997 | Teetzel | |
| 5,758,448 A | 6/1998 | Thummel | |
| 5,816,683 A | 10/1998 | Christiansen | |
| 5,849,007 A | 12/1998 | Furhberg et al. | |
| 5,957,441 A | 9/1999 | Tews | |
| 6,112,962 A | 9/2000 | Matthews | |
| 6,185,854 B1 | 2/2001 | Solinsky et al. | |
| 6,190,025 B1 | 2/2001 | Solinsky | |

| | | | | |
|---|---|---|---|---|
| 6,196,531 | B1 | 3/2001 | Makino et al. | |
| 6,222,700 | B1 | 4/2001 | Martin et al. | |
| 6,276,088 | B1 | 8/2001 | Matthews et al. | |
| 6,363,648 | B1 | 4/2002 | Kranich et al. | |
| 6,378,237 | B1 | 4/2002 | Matthews et al. | |
| 6,508,027 | B1 | 1/2003 | Kim | |
| 6,574,901 | B1 | 6/2003 | Solinsky et al. | |
| 6,606,813 | B1 | 8/2003 | Squire et al. | |
| 6,622,416 | B2 | 9/2003 | Kim | |
| 6,629,381 | B1 * | 10/2003 | Keng | 42/124 |
| 6,655,069 | B2 | 12/2003 | Kim | |
| 6,851,214 | B2 | 2/2005 | Oz | |
| 2001/0022044 | A1 | 9/2001 | Spinner | |
| 2003/0101632 | A1 | 6/2003 | Davenport et al. | |

FOREIGN PATENT DOCUMENTS

| | | | |
|---|---|---|---|
| CH | 217521 | | 10/1941 |
| DE | 1101223 | | 9/1959 |
| EP | 0 335 281 | A2 | 10/1989 |
| FR | 2 592 149 | A1 | 6/1987 |
| GB | 13444 | | 11/1885 |
| GB | 818524 | | 8/1959 |
| GB | 2 052 025 | A | 1/1981 |

OTHER PUBLICATIONS

Glock Inc., Glock Perfection Instructions for Use, Aug. 1999.
Insight Technology Incorporated, M3 Tactical Illuminator Operator Manual, date prior to Apr. 2003.
Surefire, LLC, 2002 Surefire Weaponlight Catalog (including pp. 8-12 and 52), date 2002.
Insight Technology, "M3X Operator's Manual" (24 pages), dated Jul. 2003.

* cited by examiner

ACCESSORY DEVICES FOR FIREARMS

CROSS REFERENCE TO RELATED APPLICATION

This application is a continuation-in-part of U.S. patent application Ser. No. 10/819,535, filed Apr. 6, 2004 now U.S. Pat. No. 7,117,624, incorporated herein by reference.

BACKGROUND OF THE INVENTION

This invention relates to accessory devices for being mounted to a firearm, and more particularly to a light beam generator for being mounted to a firearm including a handgun.

Accessory devices including light beam generators, such as flashlights and laser aiming devices, have long been adapted for being secured to firearms as target illuminators and laser sights. As particularly relating to handguns, such accessory devices may utilize a longitudinal rail carried by the frame of the handgun and forwardly of the trigger guard, which rail may be integral with the frame as disclosed in U.S. Pat. No. 6,276,088, or such rail may be provided as a separate structure removably attachable to the handgun as disclosed in U.S. Pat. No. 6,378,237, both patents issued to John W. Matthews and Paul Y. Kim and assigned to the assignee of the present invention, which patents are incorporated herein by reference.

Handgun manufacturers have introduced various handgun models having a longitudinal rail along the handgun's frame, below the barrel and forwardly of the trigger guard, such rail being configured with two longitudinal grooves, one along each side of the rail, and further configured with a transverse slot in the bottom surface of the rail. As is well known, such rails are intended for cooperating with accessories such as a light beam generator having a housing configured with a pair of longitudinal tongues complementing the longitudinal grooves for slidably retaining the light beam generator on the rail. A latch on the light beam generator housing co-acts with the transverse slot in the rail for releasably preventing further longitudinal movement of the light beam generator along the rail when the light beam generator is at a predetermined longitudinal position.

The longitudinal rails of handguns of some manufacturers may be of different configuration than the longitudinal rails of handguns of other manufacturers. For example, some handguns include a longitudinal rail commonly known as a Universal rail, while other handguns include a rail commonly known as a Picatinny rail. The slot width of the Universal rail is substantially less than the slot width of the Picatinny rail. Until the present invention, an accessory device securable to one type of rail was not securable to another type of rail.

SUMMARY OF THE INVENTION

The present invention provides an accessory device that is adapted to accommodate handguns and other firearms carrying longitudinal rails of different configurations. For example, the accessory device of the present invention may be secured to a longitudinal rail carried by a firearm having a slot width different than the slot width of another longitudinal rail carried by a firearm. In a particular example, the accessory device of the present invention accommodates a Universal rail as well as a Picatinny rail.

A preferred embodiment of the accessory device of the present invention comprises a light beam generator, such as a target illuminator or a laser sight, that includes a removably attachable switch device for being replaced by or interchanged with another switch device having a different or modified switch configuration.

The aforementioned parent application Ser. No. 10/819,535 discloses, according to one aspect of that invention, an accessory device for a firearm including a frame, a longitudinal barrel, a longitudinal rail carried by the frame, and a depression in the rail, the accessory device comprising: a housing; elongate members removably secured to the housing, the elongate members complementing the rail for enabling the housing to be retainably slid along the rail; and a plate pivotally secured to the housing about a transverse axis and having a free end biased away from the housing, the plate including a protuberance in the vicinity of the free end, the protuberance receivable by the depression for stopping sliding of the housing along the rail. The plate is captured to the housing by the elongate members secured to the housing, and the plate is removable from its securement about the transverse axis when the elongate members are removed from the housing.

The plate preferably includes transversely extending arms through the housing, which arms are captured to the housing by the elongate members when secured to the housing, and the arms are adapted to be urged by an operator for pivoting the plate about the transverse axis toward the housing.

In a preferred embodiment disclosed in the parent application, as well as in the present application, the accessory device is a light beam generator. The light beam generator of the parent application preferably comprises: a housing; elongate members removably secured to the housing, the elongate members complementing the rail for enabling the housing to be retainably slid along the rail; a plate pivotally secured to the housing about a transverse axis and having a free end biased away from the housing, the plate including a protuberance in the vicinity of the free end, the plate receivable by the depression for stopping sliding of the housing along the rail; a light emitter assembly carried by the housing; a battery carried by the housing in circuit for energizing the light emitter assembly when switch actuated; and a switch device including a switch actuator for the battery. The switch device preferably comprises a tail cap switch pivotally secured to the housing about a pivot axis, the tail cap switch preferably removable from its pivotal securement. The switch actuator is preferably operable by either hand of an operator when the housing is installed on the rail for placing the switch device in a CONSTANT ON or OFF position, and operable by either hand of the operator when the housing is installed on the rail for placing the switch device in a MOMENTARY ON position. A remote switch actuator may be provided for communicating with the switch device for remotely actuating the switch device to a MOMENTARY ON position.

According to a further aspect of the invention disclosed in the parent application, a method is provided of assembling an accessory device for installation on a first rail having a depression and carried by a firearm, comprising: providing the accessory device including a housing; providing elongate members complementing the rail; providing a plate having a protuberance in the vicinity of an end thereof, the protuberance sized for being received by the depression; pivotally securing the plate to the housing with such end biased away from the housing; and removably securing the elongate members to the housing with the elongate members capturing the plate to the housing and enabling the housing to be retainably slid along the rail. The method may further include: removing the elongate members from the housing;

removing the plate from the housing; providing a second plate having a protuberance in the vicinity of an end thereof, the protuberance of the second plate sized for being received by a depression in a second rail carried by a firearm, the protuberance of the second plate being of a different size than the protuberance in the first plate; pivotally securing the second plate to the housing with such second plate end biased away from the housing; and removably securing the elongate members to the housing with the elongate members capturing the second plate to the housing and enabling the housing to be retainably slid along the second rail.

According to yet another aspect of that invention, there is provided a method of adapting an accessory device normally installable on a first rail carried by a firearm and having a depression, for installation on a second rail carried by a firearm and having a depression of a different size than the depression of the first rail, comprising: providing the accessory device including a housing, a first plate having a protuberance in the vicinity of an end thereof, the protuberance of the first plate sized for being received by the depression in the first rail, the plate being removably pivotally secured to the housing along a transverse axis with such end thereof biased away from the housing, and elongate members complementing the first rail and removably secured to the housing and capturing the plate to the housing, the elongate members enabling the housing to be retainably slid along the first rail; removing the elongate members from the housing; removing the first plate from the housing; providing a second plate having a protuberance in the vicinity of an end thereof sized for being received by the depression in the second rail; removably pivotally securing the second plate to the housing along a transverse axis with such end of the second plate biased away from the housing; and removably securing elongate members complementing the second rail to the housing and capturing the second plate to the housing and enabling the housing to be retainably slid along the second rail. In the elongate members securing step, the elongate members being secured may be the same elongate members removed in the elongate members removing step.

According to one aspect of the present invention, there is provided an improved accessory device for a firearm including a longitudinal barrel, a longitudinal rail carried by the firearm, and a transverse slot in the rail, the accessory device comprising: a housing having a top surface; elongate rail interface members along the housing complementing the rail for enabling the housing to be retainably slid along the rail with the housing's top surface facing the rail; an elongate latch carried by the housing and transversely slidable along the housing's top surface when the latch is transversely aligned with the slot in the rail, from an unlatched position disengaged from the slot to a latched position engaging the slot; and a latch retainer carried by the housing transversely locking the elongate latch when in its latched position, the latch retainer adapted for being manipulated by a user for unlocking the elongate latch from its latched position and for permitting the elongate latch to be transversely urged by the user to its unlatched position with the elongate latch transversely retained to the housing. The elongate latch preferably extends through an opening in a side of the housing, and the latch retainer and the latch are adapted for preventing transverse withdrawal of the latch through the opening when the latch is in its unlatched position.

The preferred embodiment of the improved accessory device includes an adjustable device carried by the housing and longitudinally spaced from the latch, the adjustable device being adapted for supportively engaging the housing to the rail. The adjustable device provides enhanced vertical stability of the accessory device with respect to the rail.

Preferably, the elongate rail interface members are removably secured to the housing, such as along opposing longitudinal sides of the housing. In the preferred embodiment, the latch extends transversely through respective openings in such opposing longitudinal sides of the housing, and the secured elongate rail interface members cooperate with such openings for restraining the latch from movement normal to the top surface of the housing.

In the preferred embodiment, the latch retainer is removably secured to the housing, preferably pivotally secured to the housing about a transverse axis. The elongate latch includes an elongate depression or groove for cooperating with the latch retainer for guiding the latch when the latch is transversely urged by a user.

According to another aspect of the present invention, there is provided an accessory device for a firearm including a longitudinal barrel, a longitudinal rail carried by the firearm, and a transverse slot in the rail, the accessory device comprising: a housing having a top surface and an upstanding wall transversely extending along the top surface; elongate rail interface members along the housing complementing the rail for enabling the housing to be longitudinally slid along the rail; a bar transversely carried by the housing, the bar including an upper portion for being transversely received by the slot, the bar including a lower portion having a first (preferably front) surface in transverse sliding engagement with the wall and a second (preferably rear) surface opposite the first surface including an elongate depression terminating at a first end, the elongate depression terminating at a second end with a second depression of depth greater than the depth of the elongate depression; and a retainer mechanism for the bar, the retainer mechanism secured to the housing and having a transverse (preferably front) edge portion including a longitudinally (preferably forwardly) extending protuberance, the edge portion received by the elongate depression with the protuberance received by the second depression for preventing sliding of the bar along the wall, the retainer mechanism adapted for being manipulated by a user for longitudinally (preferably rearwardly) urging the edge portion from the elongate depression and the protuberance from the second depression whereupon the bar is transversely slidable along the wall with the protuberance captured within the elongate depression.

According to this aspect of the present invention, and included in the preferred embodiment thereof, the retainer mechanism includes a forwardly biased elongate retainer member having such front edge portion, as well as a frame secured to the housing and a compression spring longitudinally securing the elongate retainer member to the frame. The retainer mechanism preferably includes a top plate secured to the frame and having a transverse front edge longitudinally spaced from the housing's rearwardly facing wall. The top plate preferably includes a cutout portion comprising a tab, and an actuator is interposed between the top surface of the housing and the tab, which actuator is operable by a user for causing the tab to contact the bottom surface of the rail and to thereby enhance the vertical stability of the housing with respect to the rail.

The retainer mechanism is preferably pivotally secured to the housing about a transverse axis, and the forwardly biased elongate retainer member may include lateral arms extending through the housing and rearwardly urgeable by a user for rearwardly displacing the forwardly biased elongate retainer member. In the preferred embodiment, the elongate rail interface members are removably securable to the housing, and the retainer mechanism is pivotally restrained to the housing by the elongate rail interface members when such rail interface members are secured to the housing. The retainer mechanism is removable from its securement about its transverse pivotal axis when the elongate rail interface members are removed from the housing.

According to yet another aspect of the present invention, there is provided a method of assembling an accessory device for installation on a longitudinal rail carried by a firearm, the rail having a transverse slot therein, comprising: providing the accessory device including a housing having a top surface and a transverse wall along the top surface; providing elongate rail interface members complementing the rail; providing an elongate latch member sized for being received by the slot in the rail; providing a latch retainer having a forwardly biased front edge portion; placing the latch member to the front edge portion of the latch retainer; securing the latch retainer to the housing with the latch member interposed between the wall and the latch retainer front edge portion for being transversely slid along the top surface of the housing; and removably securing the elongate rail interface members to the housing with such interface members capturing the latch retainer and the latch member to the housing and enabling the housing to be retainably slid along the rail. The method further includes sliding the latch member transversely along the top surface of the housing to an unlatched position; sliding the housing longitudinally along the rail until the latch member is transversely aligned with the slot in the rail; and sliding the latch member transversely for being received by the slot.

The latch member preferably includes an elongate depression terminating with a second depression of greater depth; the forwardly biased front edge potion of the latch retainer includes a forwardly extending protuberance; and, in the latch member placing step, the forwardly biased front edge portion of the latch retainer is received by the elongate depression of the latch member with the protuberance received by the second depression.

When installing the accessory device to the rail, the method includes rearwardly urging the forwardly biased front edge portion of the latch retainer for urging such edge portion from the elongate depression and the protuberance from the second depression for permitting transverse sliding of the latch member with the protuberance captured within the elongate depression; sliding the latch member transversely along the top surface of the housing to an unlatched position; sliding the housing longitudinally along the rail until the latch member is transversely aligned with the slot in the rail; and sliding the latch member transversely for being received by the slot, until the forward protuberance is received by the second depression and the forwardly biased front edge portion of the latch retainer is received by the elongate depression in the latch member, thereby locking the latch member in its latched position.

When it is desired to remove the accessory device from the rail, the method may continue by rearwardly urging the forwardly biased front edge portion of the latch retainer for displacing such edge portion from the elongate depression and the protuberance from the second depression such that the latch member is transversely slidable with the protrusion captured within the elongate depression; sliding the latch member transversely along the top surface of the housing to an unlatched position; and sliding the housing longitudinally along the rail until the housing is removed therefrom.

The method of the present invention may be practiced for adapting an accessory device normally installable on a first rail with a transverse slot, for installation on a second rail having a slot of a different width than the slot of the first rail, including: removing the elongate rail interface members from the housing; removing the latch member from the housing; providing a second latch member sized for being slidably received by the slot in the second rail carried by a firearm; placing the second latch member to the front edge portion of the latch retainer with the latch member interposed between the wall and the retainer front edge portion for being transversely slid along the top surface of the housing; and removably securing the elongate rail interface members to the housing with the elongate rail interface members capturing the latch retainer and the latch member to the housing and enabling the housing to be retainably slid along the second rail.

BRIEF DESCRIPTION OF THE DRAWINGS

The novel features believed to be characteristic of the inventions, together with further advantages thereof, will be better understood from the following description considered in connection with the accompanying drawings in which preferred embodiments of the inventions are illustrated by way of example. It is to be expressly understood, however, that the drawings are for the purpose of illustration and description only and are not intended as a definition of the limits of the invention.

DETAILED DESCRIPTION OF THE PREFERRED EMBODIMENTS

Figure 1:
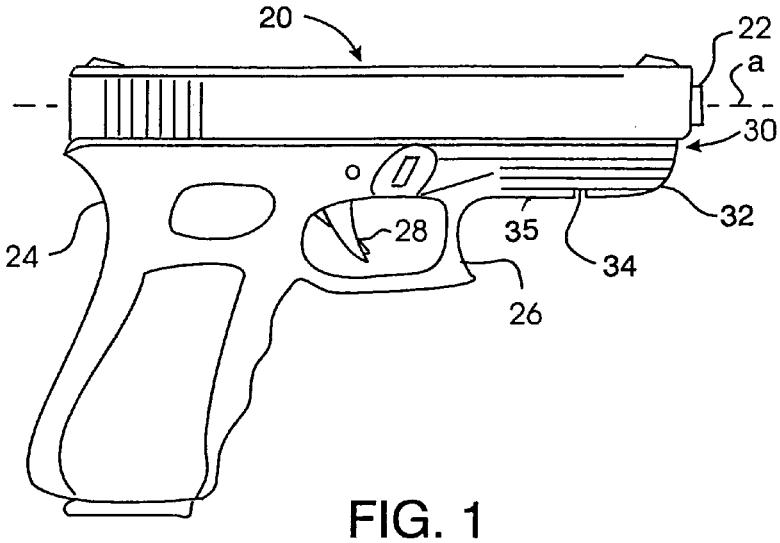
FIG. 1 is a side elevation view of a firearm having a longitudinal rail structure to which may be removably secured an accessory device according to both the present invention and the invention disclosed in the aforementioned parent application Ser. No. 10/819,535.

Turning first to FIG. 1, there is illustrated an example of a firearm 20, specifically a handgun including a barrel 22 extending along a longitudinal axis a from the handgun's frame 24. The handgun 20 includes a trigger guard 26 in front of the handgun's trigger 28.

Figure 4:
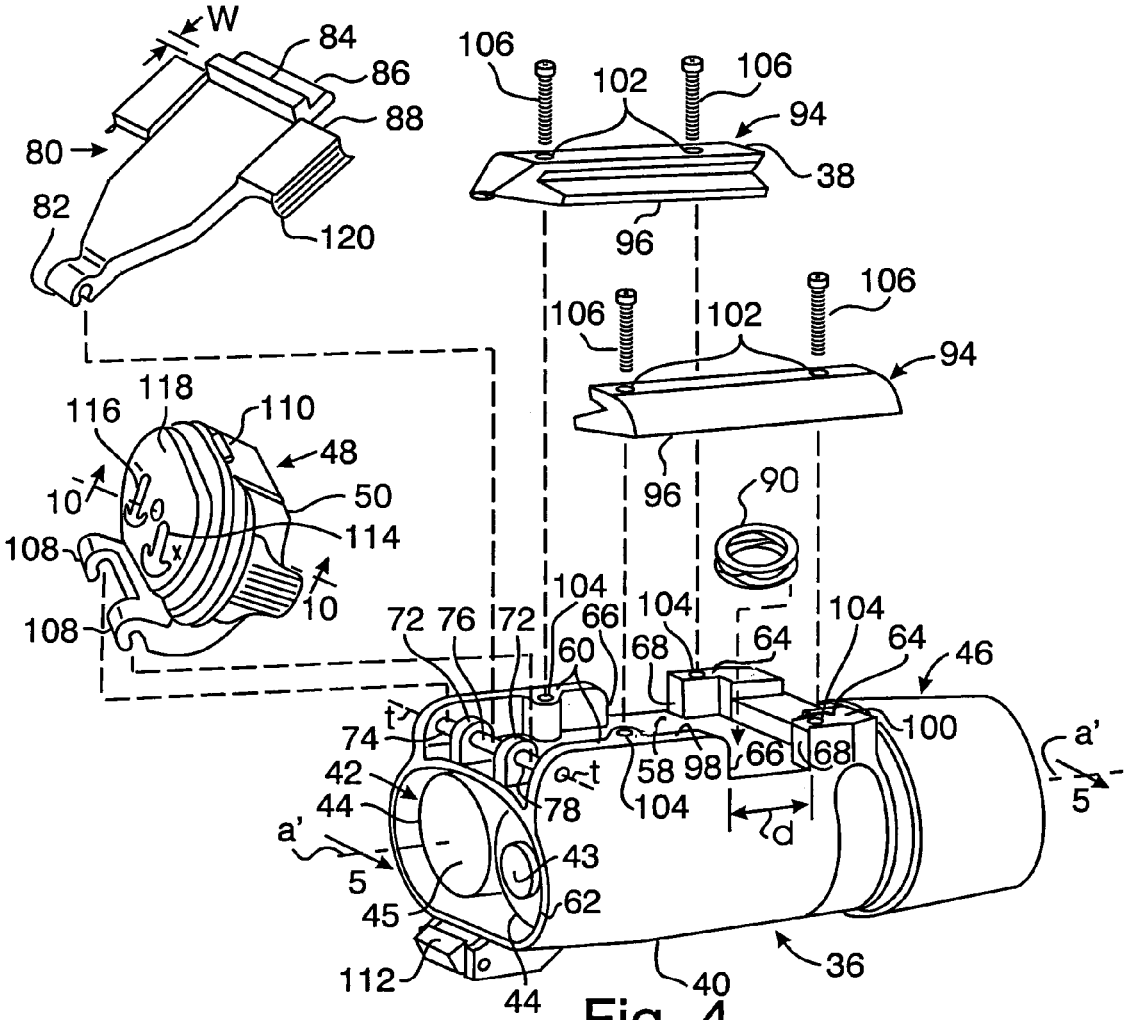
FIG. 4 is an exploded side/rear perspective view of the light beam generator of FIGS. 2 and 3, illustrated during assembly of various components thereof.
Figure 5:
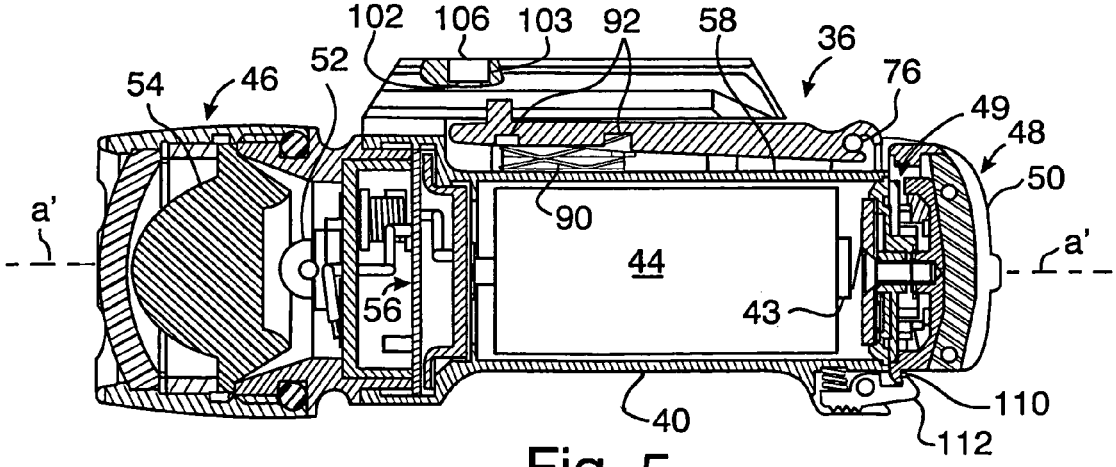
FIG. 5 is a longitudinal cross-sectional view of the assembled light beam generator of FIG. 4 (in further increased scale), taken along a vertical plane along the light beam generator's longitudinal axis a' (the line 5-5 of FIG. 4) and viewed in the direction of the appended arrows.
Figure 24:
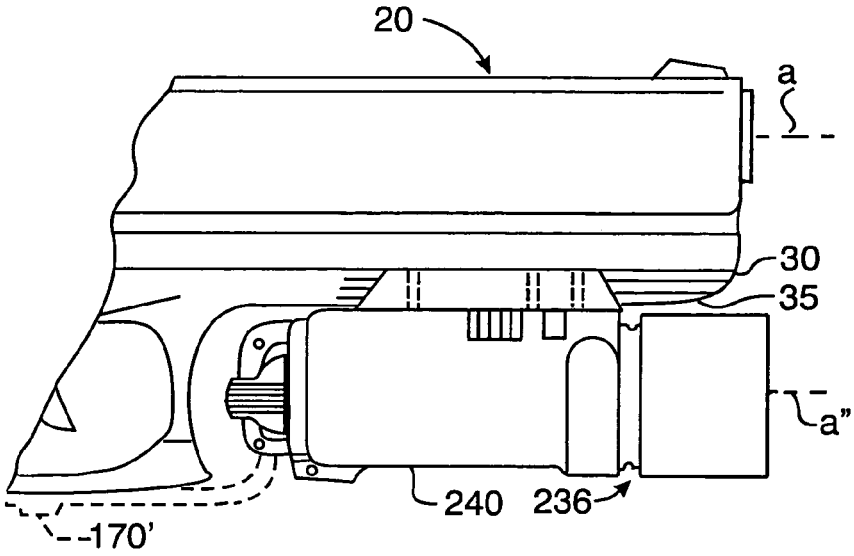
FIG. 24 is a side elevation view of a preferred embodiment of a stability enhanced accessory device according to the present invention, specifically a preferred embodiment of a light beam generator removably secured to the rail structure of the firearm of FIG. 1 (in increased scale)
Figure 27:
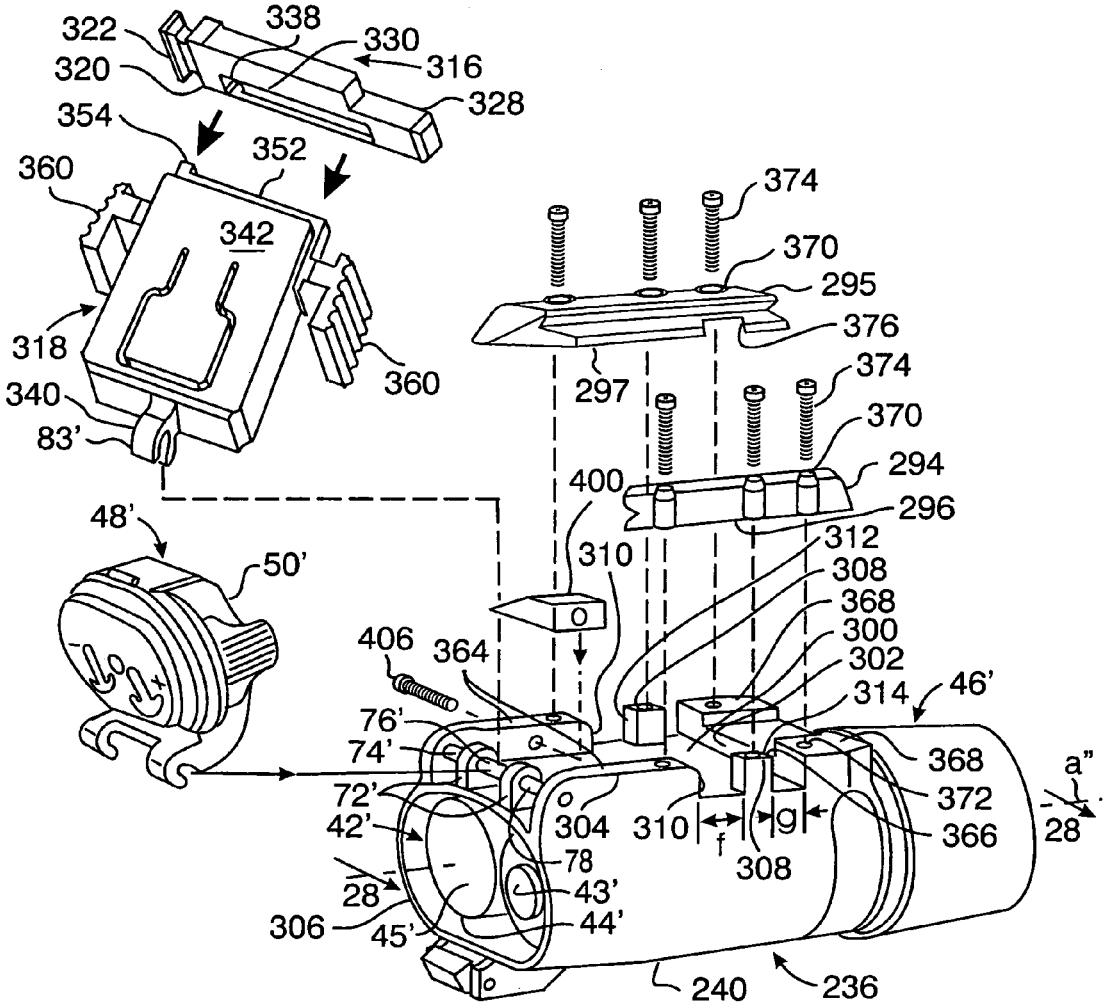
FIG. 27 is an exploded side/rear perspective view of the light beam generator of FIGS. 24-26, illustrated during assembly of various components thereof.
Figure 28:
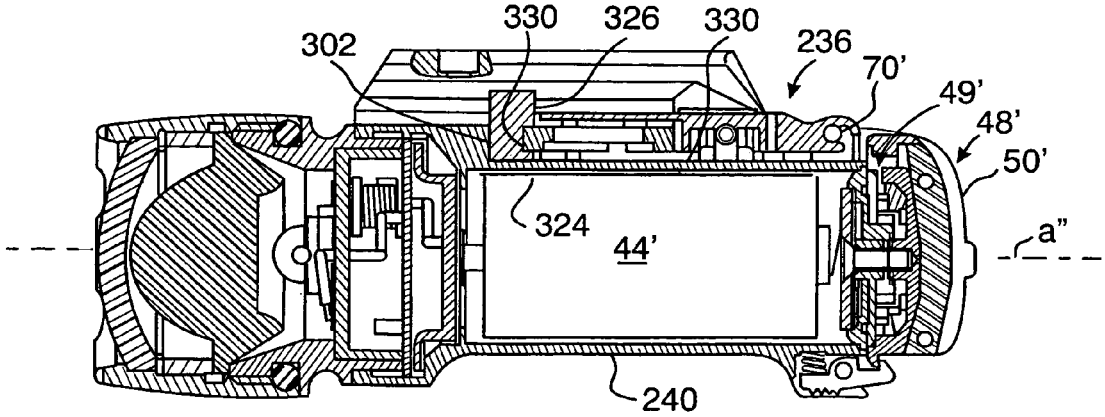
FIG. 28 is a longitudinal cross-sectional view of the assembled light beam generator of FIG. 27, taken along a vertical plane along the light beam generator's longitudinal axis a" (the line 28-28) of FIG. 27 and viewed in the direction of the appended arrows.
Figure 29A:
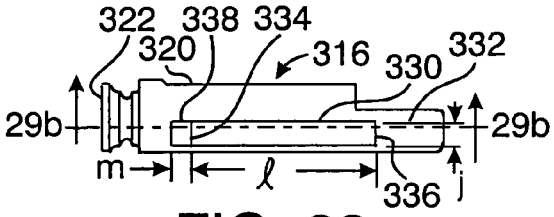
FIG. 29*a* is a rear elevation view of an example of a preferred embodiment of a slide latch included in the preferred embodiment of the enhanced accessory device or light beam generator of FIGS. 25-28.
Figure 29B:
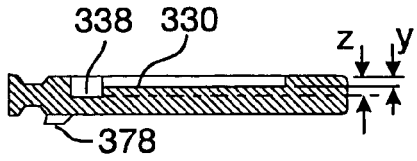
FIG. 29*b* is a cross-sectional view of the slide latch of FIG. 29*a*, taken along the line 29*b*-29*b* of FIG. 29*a* and viewed in the direction of the appended arrows.
Figure 29C:
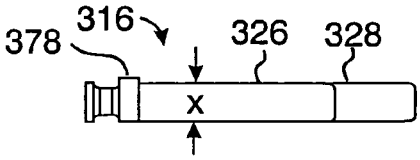
FIG. 29*c* is a top plan view of the slide latch of FIG. 29*a;*
Figure 29D:
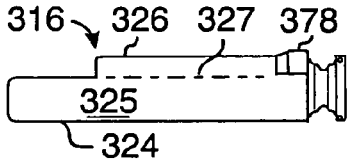
FIG. 29*d* is a front elevation view of the slide latch of FIG. 29*a;*
Figure 30A:
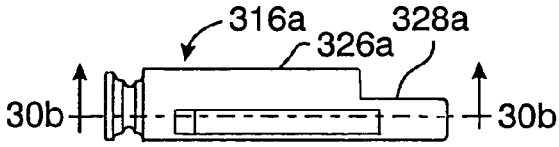
FIG. 30*a* is a rear elevation view of a second example of a preferred embodiment of a slide latch included in the preferred embodiment of the enhanced accessory device or light beam generator of the present invention.
Figure 30B:
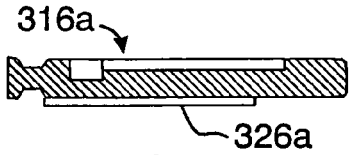
FIG. 30*b* is a cross-sectional view of the slide latch of FIG. 30*a*, taken along the line 30*b*-30*b* of FIG. 30*a* and viewed in the direction of the appended arrows.
Figure 30C:
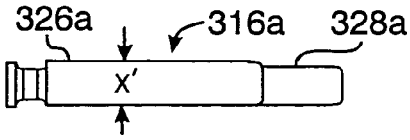
FIG. 30*c* is a top plan view of the slide latch of FIG. 30*a;*
Figure 30D:
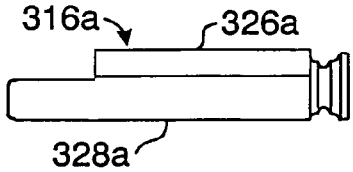
FIG. 30*d* is a front elevation view of the slide latch of FIG. 30*a;*
Figure 31:
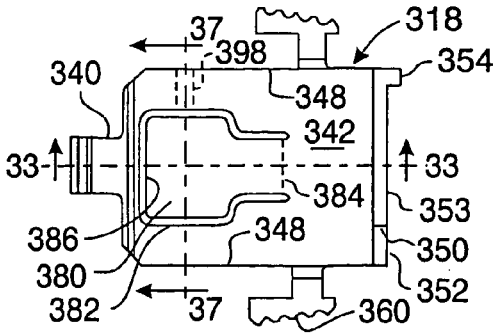
FIG. 31 is a top plan view of a preferred embodiment of a slide latch retainer included in the preferred embodiment of the enhanced accessory device or light beam generator of FIGS. 25-28.
Figure 32:
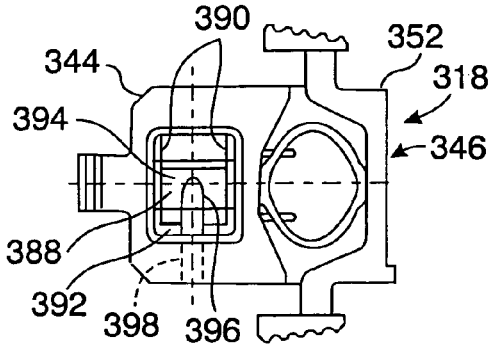
FIG. 32 is a bottom plan view of the slide latch retainer of FIG. 31.
Figure 33:
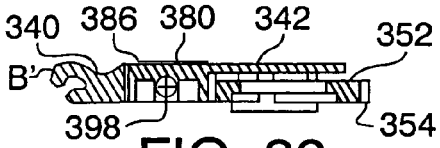
FIG. 33 is a cross-sectional view of the slide latch retainer of FIG. 31, taken along the line 33-33 of FIG. 31 and viewed in the direction of the appended arrows.
Figure 34:
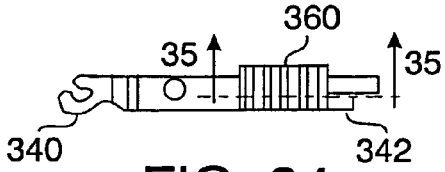
FIG. 34 is a side elevation view of the slide latch retainer as viewed in FIG. 32.
Figure 35:
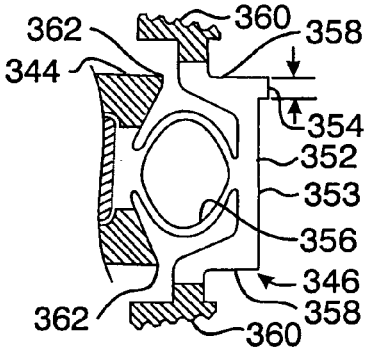
FIG. 35 is a cross-sectional view of a fragment of the slide latch retainer, taken along the line 35-35 of FIG. 34 and viewed in the direction of the appended arrows.
Figure 37:
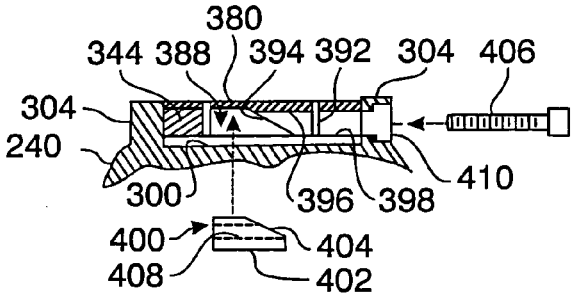
FIG. 37 is a cross-sectional view of the slide latch retainer, taken along the line 37-37 of FIG. 31 and viewed in the direction of the appended arrows, in exploded combination with elevation views of a vertical stabilizer mechanism included in the preferred embodiment, the slide latch retainer being shown as installed to a fragment of the light beam generator housing.

As used herein, "longitudinal" describes a direction along or parallel to the longitudinal axis a of the firearm's barrel, or along or parallel to the longitudinal axis a' of the light beam generator 36 (see also FIGS. 2, 4 and 5), or along or parallel to the longitudinal axis a" of the light beam generator 236 (see also FIGS. 24, 27 and 28), which axes a' and a" are parallel to the axis a when the light beam generator 36 or 236 is installed on the firearm; "transverse" describes a horizontal direction perpendicular to the axis a (or axis a' or axis a") when the barrel 22 (or light beam generator 36 or 236) is horizontally positioned; "above" means vertically above and "upward" means vertically upward when the firearm barrel 22 (or light beam generator 36 or 236) is horizontally positioned; "below" or "beneath" means vertically below and "downward" means vertically downward when the firearm barrel 22 (or light beam generator 36 or 236) is horizontally positioned; "front" or "forward" describes the longitudinal direction toward the muzzle of the barrel 22 or the light emitter assembly 46 (i.e., to the right as shown in FIGS. 1, 2, 4, 24, 27, 31-36, 40 and 41) and to the left as shown in FIGS. 5 and 28); and "rear" or "rearward" describes the longitudinal direction opposite the front or forward direction (i.e., to the left as shown in FIGS. 1, 2, 4, 24, 27, 31-36, 40 and 41, and to the right as shown in FIGS. 5 and 28).

Figure 3:
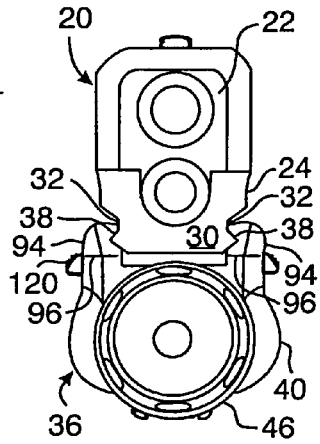
FIG. 3 is a front elevation view of the firearm and secured light beam generator of FIG. 2.
Figure 25:
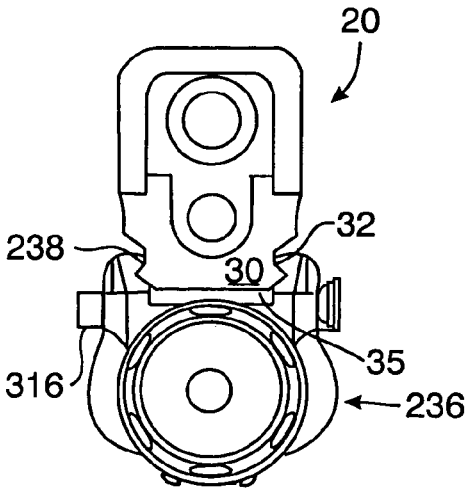
FIG. 25 is a front elevation view of the firearm and secured light beam generator of FIG. 24.

The handgun 20 includes a longitudinal rail 30 along the frame 24, below the barrel 22 and forwardly of the trigger guard 26. Such rails are well known in the handgun art, for mounting accessories thereto such as a light beam generator. The rail 30 is configured with two longitudinal grooves 32, one along each side of the rail 30, and is further configured with a transverse slot 34 in the bottom surface 35 of the rail 30. As is well known, such rails are intended for cooperating with accessories such as a light beam generator having a housing configured with a pair of longitudinal tongues (in this respect, see the tongues 38 and 238 of the preferred light beam generators 36 and 236, respectively, of the present inventions as represented in FIGS. 3 and 25), with such tongues 38 or 238 complementing the longitudinal grooves 32 for slidably retaining such light beam generator on the rail 30. A latch on the light beam generator housing co-acts with the transverse slot 34 in the rail 30 for releasably preventing further longitudinal movement of the light beam generator along the rail 30 when the light beam generator 36 or 236 is at a predetermined position along the rail 30.

Although the rail 30 is represented in FIG. 1 as being integral with the frame 24 of the handgun 20, the rail 30 may also be provided as a separate structure that may be removably attached to the handgun beneath the barrel and forwardly of the trigger guard. As previously noted, such rails for handguns, both integral to the frame and removably attachable to the handgun, as well as light beam generators adapted for being removably attached to such rails as discussed above, are disclosed in the aforementioned U.S. Pat. Nos. 6,276,088 and 6,378,237 incorporated herein by reference.

Figure 2:
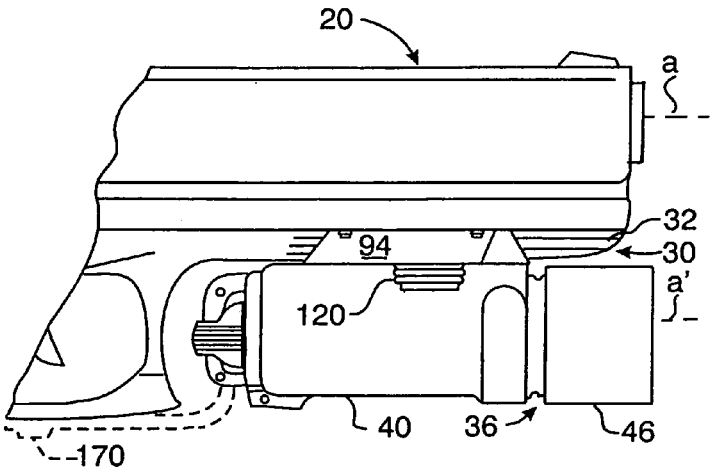
FIG. 2 is a side elevation view of a preferred embodiment of an accessory device according to the parent application, specifically a preferred embodiment of a light beam generator, removably secured to the rail structure of the firearm of FIG. 1 (in increased scale)

Handgun manufacturers have introduced various handgun models with integral rails having longitudinal grooves of the type shown in FIGS. 1-3. Although such longitudinal grooves among manufacturers have been of substantially similar dimensions, the transverse slots in the rails of handguns of some manufacturers are of different width than the transverse slot in the rails of handguns of other manufacturers. Specifically, the rails of some handguns include a transverse slot of one predetermined width while the rails of other handguns include a transverse slot of another predetermined width. For example, some handguns include a rail commonly known as a Universal rail, while other handguns include a rail commonly known as a Picatinny rail; the slot width of the Universal rail is substantially less than the slot width of the Picatinny rail. The accessory device or light beam generator 36 or 236 of the present invention accommodates both types of rails.

The light beam generator 36 or 236 further includes a removably attachable switch device, for being replaced by or interchanged with another switch device having a different or modified switch configuration.

Turning also to FIGS. 4-8, the light beam generator 36 includes a housing 40 in which is contained a power source such as a battery 42 of one or more battery cells 44 (for example, two 3-volt lithium battery cells 44). A light emitter assembly 46 is carried by the housing 40 forwardly of the battery 42 and in circuit with a positive front terminal of one of the battery cells 44 and a negative front terminal of another of the battery cells 44. A switch device 48 preferably situated at the rear of the housing 40 in and including a tail cap 50, includes a switch actuator assembly 49 for selectively completing and opening the light emitter energization circuit. In the embodiment shown, this is accomplished by the switch actuator assembly 49 establishing a conductive path between the rear positive terminal 43 of one of the battery cells 44 and the rear negative terminal 45 of the other of the battery cells 44 for placing the switch device 48 in an ON position for causing the battery 42 to energize the light emitter assembly 46, and by opening such conductive path for placing the switch in an OFF position where the battery 42 does not energize the light emitter assembly 46.

As shown in FIG. 5, a preferred light emitter assembly 46 may include a light emitter 52 such as a light emitting diode (LED), preferably a high luminous flux LED such as a 3-watt or 5-watt LED manufactured by Lumileds Lighting, LLC (of San Jose, Calif.) and marketed under the trademark LUXEON including such LEDs marketed under the LUXEON STAR trademark.

With such an LED as the light emitter 52, the emitted light may be directed by a lens system contained in the light emitter assembly 46 including a totally internal reflective (TIR) lens 54 (as represented in FIG. 5), or by a parabolic reflector system as disclosed in U.S. patent application Ser. No. 10/346,537 of Paul Y. Kim and William A. Hunt, assigned to the assignee of the present invention, which patent application is incorporated herein by reference. The light emitter assembly 46 may alternatively include an incandescent lamp as the light emitter 52, such as a high intensity tungsten light bulb, with the emitted light preferably directed by a parabolic reflector.

In either case, the light emitter assembly 46 may further include a controller 56 for regulating the power to the light emitter for providing light output of constant brightness with decreasing battery voltage over time. The use of such controllers is discussed in the aforesaid patent application Ser. No. 10/346,537 incorporated herein by reference.

The preferred embodiment of the housing 40 of the light beam generator 36 includes a substantially flat upwardly facing surface 58 with two upstanding first wall segments 60 longitudinally extending forwardly along opposite sides of the surface 58 from the vicinity of the housing's rear end 62, and two upstanding second wall segments 64 forwardly of the respective first wall segments 60. The forward generally vertical ends 66 of the respective first wall segments are transversely aligned, and the rear generally vertical ends 68 of the respective second wall segments 64 are transversely aligned and spaced from the second wall segments' forward ends 68 by a predetermined distance d.

A transversely disposed pin 70 is secured to the housing 40 in the vicinity of its rear end 62 and above the housing's flat surface 58. As shown in FIG. 4, the transverse pin 70 is secured to the first wall segments 60 in the vicinity of their rear ends and above the flat surface 58. The pin 70 additionally extends through apertures in two upstanding protuberances or partitions 72 from the flat surface 58. The two partitions 72 are laterally spaced so as to divide the transverse pin into three exposed segments 74, 76, 78 which may be of substantially equal lengths.

The light beam generator 36 includes a latch lever plate 80 having a generally U-shaped rear end 82 configured for receiving the middle segment 76 of the transverse pin 70. One leg (preferably the upper leg 83) of the U may curve over a portion of the generally rearwardly facing opening of the U, and the plate 80 is preferably made of a material such that the legs are somewhat resilient. As illustrated in FIG. 4, the latch plate 80 is installed to the housing 36 by placing the opening of the latch plate's rear end 82 to the transverse pin segment 76, and the installer urging the rear end 82 to snap onto the pin segment 76. The latch plate 80 accordingly is hinged at its rear end 82 about the transverse hinge pin 70, specifically about the hinge pin segment 76; i.e., the plate 80 is pivotally secured to the housing 40 about a transverse axis t along the pin 70.

The top surface of the plate 80 includes an upstanding protuberance, preferably a transversely disposed elongate protuberance 84, in the vicinity of the plate's front end 86, the elongate projection 84 having a width w (along the longitudinal direction) slightly less than the slot 34 of the firearm's rail 30 for being received therein. Lateral arms 88 transversely extend outwardly from opposite sides of the plate 80, the arms 88 situated in the vicinity of the plate's front end 86 and being of a width d' (along the longitudinal direction) slightly less the distance d between the forward ends 66 of the first wall segments 60 and the respective rear ends 68 of the second wall segments 64 (see FIG. 4) such that the arms 88 are received between such ends 66 and 68. The vertical height of the end portions 66 and 68 is preferably greater than the sum of the vertical thickness of the plate 80 and the vertical height of the protuberance 84.

During installation of the plate 80 to the housing 40, after being hinged to the hinge pin segment 76 the plate 80 is pivoted toward the housing's upwardly facing surface 58 (i.e., in the clockwise direction as viewed in FIG. 4) with a wave spring 90 held by an annular groove 92 in the underside of the plate 80 (see also FIGS. 5 and 7) in the longitudinal vicinity of the protuberance 84 and the lateral arms 88, until the spring 90 contacts the flat upwardly facing surface 58 of the housing 40 while the lateral arms 88 of the plate 80 are caused to enter the space between the wall surfaces 66 and 68.

The accessory device or light beam generator 36 includes two elongate members 94 removably secured to the housing 40, for interfacing with the firearm rail 30 to enable the housing 40 to be retainably slid along the rail 30 (see, in particular, FIGS. 1-5). Each elongate member 94 includes an inwardly directed tongue 38 longitudinally extending along such member 94; i.e., such elongate rail interface members 94 are installed to the housing 40 with the longitudinal tongue 38 of one of the members 94 facing the longitudinal tongue 38 of the other of the members 94, the tongues 38 complementing the firearm's longitudinal grooves 32 for slidably cooperating with the firearm's longitudinal grooves 32 while being vertically retained by the rail 30 as shown in FIGS. 2 and 3.

The elongate rail interface members 94 are installed to the housing 40 after the latch plate 80 has been hinged to the hinge pin segment 76 and pivoted with its lateral arms 88 in the space between the upstanding wall segment ends 66 and 68 as discussed above. Each member 94 includes a flat bottom surface 96 for contacting the top surfaces 98 and 100 of the housing's respective wall segments 60 and 64. The members 94 include bores 102 therethrough aligned with internally threaded blind vertical bores 104 in the top surfaces 98, 100 of the housing's wall segments 60, 64, preferably forwardly of the wall segment ends 68 and rearwardly of the wall segment ends 66, the members 94 being removably secured to the wall segments 60, 64 by headed screws 106 respectively extending into the bores 102 through the member 94 and threaded into the respectively aligned threaded bores 104 in the housing 40. With the elongate members 94 so installed, their bottom surfaces 96—which contact and extend along the top surfaces 98, 100 of the wall segments 60, 64—bridge the wall segments 60, 64 and provide a ceiling to the space between the wall ends 66, 68. Such bridge or ceiling upwardly captures the lateral arms 88 within such space, while the wall ends 66, 68 longitudinally captures the lateral arms 88 within such space, resulting in the hinged latch plate 80 being captured to the housing 40 as well.

The elongate rail interface members 94 may be removed from the housing 40 by unscrewing the screws 106, and if desired the elongate rail interface members 94 may be replaced by other or different elongate rail interface members which are similarly removably securable to the housing 40. It may be appreciated that when the rail interface members 94 have been removed from the housing 40, the lateral arms 88 of the hinged latch plate 80 are no longer upwardly blocked or captured by the members 94, so that the latch plate 80 may be pivoted about the hinge pin 70 away from the surface 58 of the housing 40 and pulled away from the hinge pin segment 76. In such manner, the latch plate 80 may be removed from the housing 40 and another or different latch plate 80, which is similarly removably securable to the housing 40, may be hinged to the hinge pin 70 and upwardly captured by reinstalling the rail interface members 94.

Another feature of the preferred embodiment of the light beam generator 36 of the present invention comprises the tail cap switch device 48 which functions both as a battery cover permitting the battery cells 44 to be installed and retained in the housing 40 and as a switch for actuating the battery 42 to selectively energize the light emitter of the light emitter assembly 46. The preferred embodiment of the tail cap switch 48 is removably securable to the rear end 62 of the housing 40.

The switch device 48 includes a tail cap 50 which is hinged to the transverse hinge pin 70 by two transversely spaced-apart forward projections 108 each having a generally U-shaped end portion, one leg of the U preferably curving over a portion of the generally upwardly and rearwardly facing opening of the U. The projections 108 are preferably somewhat resilient and, as illustrated in FIG. 4, the switch device 48 is installed to the housing 36 by placing the openings of the cap's projections 108 to the transverse pin outer segments 74 and 78, the installer urging the projections 108 to snap onto the pin segments 74, 78. The tail cap 50 accordingly is hinged about the transverse hinge pin 70, specifically about the hinge pin segments 74, 78; i.e., the tail cap switch is pivotally secured to the housing 40 about a pivot axis, preferably the transverse axis t.

The installer thereupon rotates the tail cap 50 toward the housing's open rear end 62 (i.e., counterclockwise as viewed in FIG. 4) until the rear opening of the housing 40 is closed and the tail cap 50 is locked into place by cooperation of a catch 110 along the lower edge of the tail cap 50 with a spring-biased latch 112 on the housing 40 (FIGS. 4 and 5). When the tail cap 50 is in its latched position, the forwardly facing battery contacts 114, 116 on the switch device circuit board 118 are in conductive contact with the respective rear battery terminals 43, 45.

The switch device 48 may be removed from the housing 40 by manually unlatching the latch 112, pivoting the tail cap 50 upwardly about the hinge pin 70 away from the housing's rear opening (for example, to the position generally illustrated in FIG. 4) and pulling the switch device 48 away from the hinge pin segments 74 and 78. In such manner, the switch device 48 may be removed from the housing 40 and another or different switch device, which is similarly removably securable to the housing 40, may be hinged to the hinge pin 70 and locked to the rear end 62 of the housing 40 by operation of the latch 112.

When the light beam generator 36 is in its assembled condition (i.e., with the tail cap switch 48, latch plate 80 and rail interface members 94 installed to the housing 40 as described above), the assembled light beam generator 36 may be removably installed to the firearm 20. The light beam generator 36 is placed to the firearm 20 with the rear ends of the tongues 38 of the rail interface members 94 respectively engaging the forward ends of the grooves 32 of the rail 30 carried by the firearm 20. The light beam generator 36 is thereupon rearwardly urged, thereby sliding the housing 40 along the rail 30 while the housing 40 is being vertically retained by the rail 30. When the transverse upstanding protuberance 84 of the latch plate 80 contacts the bottom surface of the rail 30 (which may be facilitated by a swept-back profile of the forward portion of the rail 30 illustrated in FIGS. 1 and 2, preferably of a height at least as great as the height of the protuberance 84), the latch plate is thereby urged to pivot about the hinge pin 70 against the bias of the spring 90, until the transverse protuberance 84 enters the transverse slot 34 as the spring 90 urges the plate 80 to pivot about the hinge pin segment 76.

As earlier noted, the width w of the protuberance 84 is slightly less than the width of the slot 34 such that the protuberance 84 just fits into the slot 34. The engagement of the protuberance 84 with the slot 34 stops further longitudinal movement of the housing 40 along the rail 30, longitudinally latching the housing 40 in this position. The longitudinal positions of the slot 34 and of the protuberance 84 are preferably predetermined such that the rear end of the tail cap 50 is situated just forwardly of the handgun's trigger guard 26 when the protuberance 84 engages the slot 34.

Because the dimensional tolerances of rails 30 may differ among firearm manufacturers, and even among firearms manufactured by the same manufacturer, the rail interface members 94 may be configured to accommodate such differences. In a preferred embodiment of the rail interface members 94 for accommodating such differences, the bores 102 and the counterbores 103 in the rail interface members 94 may be slightly greater in at least the transverse direction than the respective diameters of the threaded shaft 107 and head 109 of the screws 106, for providing a loose fit in at least the transverse direction between the screws 106 and the bore 102/counterbore 103 combinations. For example, the diameters of the screw-head 109 and threaded shaft 107 may be slightly greater than the diameters of the counterbore 103 and bore 102, respectively.

During installation of the light beam generator 36 to a particular firearm rail 30, if the engagement of rail interface members 94 to the rail 30 is too loose, the installer may simply loosen the screws 106, move the rail interface members 94 inwardly (transversely toward each other) and thereupon tighten the screws 106 with the screw-heads 109 urged against the peripheral floor annular ledge 105 of the counterbores 103. If the engagement between the rail interface members 94 and the rail 30 is too tight, the installer may loosen the screws 106, move the rail interface members 94 outwardly (transversely away from each other), and tighten the screws 106 with the bottom surface 111 of the screw-heads 109 urged against the peripheral floor or annular ledge 105 of the counterbores 103.

To remove the accessory device 36 from the firearm 20, the operator downwardly urges the laterally protruding handles 120 on the ends of the lateral arms 88, causing the plate 80 to pivot about the hinge pin 70, against the bias of the spring 90, until the protuberance 84 is disengaged from the transverse slot 34. The operator thereupon forwardly urges the accessory device 36 to slide along the rail 30 until the accessory device 36 is removed therefrom.

A preferred embodiment of the tail cap switch device 48 of the present invention permits ambidextrous actuation of the switch device 48 for energizing the light emitter 52 in a CONSTANT ON/OFF mode as well as in a MOMENTARY ON mode. The switch mechanism for implementing such operation is shown in FIGS. 10-17.

A switch actuator arm 122 (e.g. fabricated of stainless steel) is affixed to an actuator disk 124 (e.g. fabricated of a polymeric material) rotatable about a circular protuberance 125 along the longitudinal axis a'. The actuator disk 124 is also rotatable about an elastomeric washer 127 (e.g. fabricated of rubber) rearwardly projecting from the tail cap insert 130 and having a rearwardly facing annular rim 128 adjacent to the forward surface of the actuator disk 124.

The actuator disk 124 is rotatable with the actuator arm 122 about the longitudinal axis a'. The disk 124 includes peripheral notches 126 engaged by ends of a latching spring 129 secured to the tail cap insert 130, for latching the disk 124 and hence the actuator arm 122 in a first rotational position where the arm 122 is transversely oriented (FIG. 14), a second rotational position where the arm 122 is rotated clockwise by a predetermined angle (say, approximately 20°), and a third rotational position where the arm 122 is rotated counterclockwise by a predetermined angle (say, approximately 20°). An operator may selectively rotate the arm into these three alternative latched positions by manipulating up or down either one of the handles 132 attached to the ends of the actuator arm 122.

The tail cap insert 130 includes a plate 134 (preferably of a plastic material such as polypropylene), having two rearwardly projecting nubs 136 at the free ends of flexible fingers 138 formed by cuts 140 through the insert plate 134. The end portions 142 of the actuator arm 122 are situated just to the rear of the rearwardly projecting nubs 136. Angularly extending from each of the actuator arm end portions 142 is a forwardly stepped tab 144. The end portions 142 of the actuator arm 122 are normally situated longitudinally just to the rear of the rearwardly projecting nubs 136 when the actuator arm 122 is in its latched first or transverse position. However, when the actuator arm 122 is in either of its latched second or third rotated positions, one of the forwardly stepped tabs 144 contacts one of the nubs 136 and urges such contacted nub 136 to be forwardly displaced. When the operator rotatably replaces the actuator arm 122 to its latched first or transverse position, the corresponding resilient finger 138 replaces the affected nub 136 to its normal or unactuated position.

When the switch actuator arm 122 is in its latched first rotational or transverse position, the operator may push either of the handles 132 in the forward direction, causing the actuator arm 122 to compress a peripheral portion of the elastomeric rimmed washer 127, rocking the actuator arm 122 so that its pushed end portion 142 is caused to be forwardly displaced. Such end portion 142 contacts and forwardly urges the correspondingly situated nub 136 for such time that the handle 132 is forwardly urged by the operator. When the operator releases the handle 132, the resiliency of the washer 127 replaces the actuator arm 122 end portion 142 to its normal undepressed position thereby permitting the resilient finger 138 of the affected nub 136 to replace such nub 136 in its normal unactuated position.

It may be appreciated that the forward displacement of the actuator arm ends, and their resilient replacement, may be implemented by other mechanisms, for example by increasing the longitudinal elasticity of the actuator arm itself.

The forward face of the insert plate 134 is covered with a non-conductive elastomeric sheet, such as a rubber membrane 146 secured to the plate 134. The tail cap insert 130 is mounted within the tail cap 50 by screw 148, with the rubber membrane 146 obverse and in proximity to the rear face 150 of the tail cap battery terminal circuit board 118 also secured to the tail cap 50 by the screw 148. The respective free end portions 151, 153 of the resilient contacts 152, 154 secured to the tail cap circuit board's rear face 150 are situated directly forwardly of the nubs 136 with the rubber membrane 146 interposed therebetween. When a nub 136 is forwardly displaced, such nub 136 presses (through the interposed rubber membrane 146) the corresponding resilient contact's end portion 151 or 153 into contact engagement with the circuit board's rear face 150.

When the tail cap 50 is installed and latched to the housing 40, the battery contacts 114, 116 secured to the circuit board's forward face 156 are in contact engagement with the respective battery cell terminals 43, 45; i.e., the battery contact 114 is in contact engagement with the positive terminal 43 of one of the battery cells 44, and the battery contact 116 is in contact engagement with the negative terminal 45 of the other of the battery cells 44.

The positive battery contact 114 (FIG. 11) conductively communicates with a first conductive area 158 (FIG. 12) on the rear surface 150 of the circuit board 118, while the negative battery contact 116 conductively communicates with a second conductive area 160 on the rear face 150 of the circuit board 118 to which the resilient contact 154 is conductively secured. When the free end 153 of resilient contact 154 on the circuit board's rear face 150 is urged into contact engagement with the first conductive area 158, there is established a conductive path between the negative battery terminal contact 116 and the positive battery terminal contact 114 (and hence between the negative and positive battery terminals 45, 43), thereby placing the switch device 48 in an ON position completing the electrical circuit between the battery 42 and the light emitter assembly 46.

The positive battery contact 114 is conductively secured to a third conductive area 162 (FIG. 11) on the forward face 156 of the circuit board 118, while the resilient contact 152 on the circuit board's rear face 150 (but which is normally electrically isolated from the conductive areas on the circuit board's rear face 150) conductively communicates with the conductive area 162 on the circuit board's forward face 156. When the free end 151 of the resilient contact 152 is urged into contact engagement with the second conductive area 160 on the circuit board's rear face 150, there is established a conductive path between the positive battery terminal contact 114 and the negative battery terminal contact 116 (and hence between the positive and negative battery terminals 43, 45), thereby placing the switch device 48 in an ON position completing the electrical circuit between the battery 42 and the light emitter assembly 46.

The switch device 48 is in an OFF position when the actuator arm 122 is in its normal position, i.e. in its first latched or transverse position and with neither of its end portions 142 forwardly depressed. It may be appreciated that when an operator manually urges either one of the handles 132 either downwardly or upwardly, the actuator arm 122 is rotated into either one of its latched second or third positions thereby placing the switch 48 in a CONSTANT ON position. The switch 48 remains in such CONSTANT ON position until the operator manually urges either one of the actuator arm handles 132 to effect a reverse rotation of the actuator arm 122 for causing the actuator arm 122 to be replaced in its latched first or transverse position, in which position the switch 48 is placed and maintained in its normal OFF position until further actuation by the operator.

It may be appreciated, as well, that the switch 48 may be actuated from an OFF position to a MOMENTARY ON position. When the actuator arm 122 is in its latched first or transverse position, the operator may manually forwardly urge or depress either one of the actuator arm handles 132, placing the switch 48 in its ON position for only as long as the operator continues to depress the handle 132. When the operator releases the handle 132, the switch 48 resumes its normal OFF position.

An important feature of the preferred embodiment of the switch 48 is its ability to be actuated by either hand of the operator, in placing the switch 48 in its CONSTANT ON position and back to its normal OFF position, as well as for placing the switch 48 in its MOMENTARY ON position.

Figure 18:
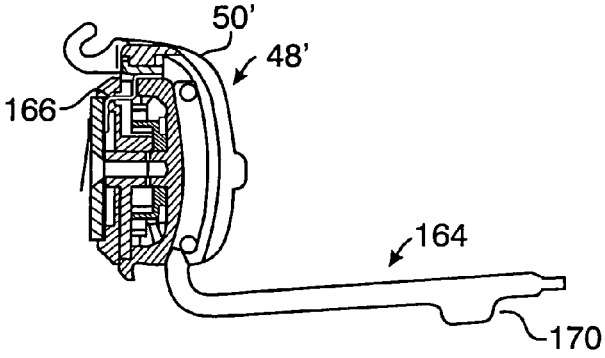
FIG. 18 is a cross-sectional view of a replaceable tail cap switch assembly similar to the tail cap switch assembly shown in FIG. 5 but further including a pressure tape switch.
Figure 19:
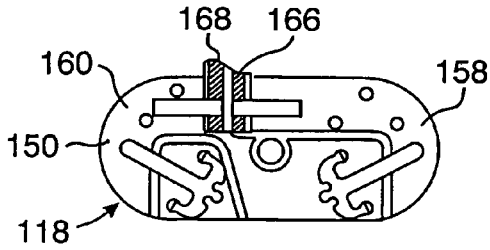
FIG. 19 is a rear view of the switch assembly circuit board of FIG. 18.

A second preferred tail cap switch embodiment 48' is shown in FIGS. 18 and 19. This second embodiment 48' is substantially the same as the first switch embodiment 48 except that, in addition to the CONSTANT ON/OFF and MOMENTARY ON switch operations actuable upon manipulation of either of the handles 132 at the ends of the switch actuator arm 122, the second switch embodiment 48' further includes a MOMENTARY ON remote switching capability provided by a type of switch commonly known as a slimline or tape switch 164. Tape switches are well known in the art, and their construction typically includes spaced electrodes in a flexible enclosure to which pressure may be manually applied by an operator for squeezing the electrodes together thereby bringing them into electrical contact with each other. The electrodes resume their spaced condition when the operator discontinues the application of such pressure. Tape switches used with illumination apparatus removably attachable to handguns are described in U.S. Pat. No. 5,654,594 issued to Bernie E. Bjornsen, III, Peter Hauk and John W. Matthews and assigned to the assignee of the present invention, and in U.S. Pat. No. 6,276,088 issued to John W. Matthews and Paul Y. Kim and assigned to the assignee of the present invention, which patents are incorporated herein by reference.

The tape switch 164 which may be utilized in connection with the second preferred embodiment 48' of the tail cap switch device includes two electrically conductive leads 166, 168 insulated from each other and extending from the tail cap 50' to a pressure sensitive switch actuator 170 remote from the tail cap 50'. The switch actuator 170 may be positioned under the trigger guard 26 (as shown in phantom in FIG. 2), or the switch actuator 170 may be of a type which horseshoes about the handgun grip as shown in the aforementioned U.S. Pat. Nos. 5,654,594 and 6,276,088.

The tail cap-situated ends of the conductive leads 166, 168 are conductively secured to the tail cap circuit board 118 for conductively communicating with the positive and negative battery cell contacts 114, 116. As shown in FIG. 19, the tape switch lead 166 is conductively secured to the first conductive area 158 of the circuit board's rear face 150, which conductive area 158 conductively communicates with the positive battery contact 114 on the circuit board's forward face 156 as previously described. The tape switch lead 168 is conductively secured to the conductive area 160 on the circuit board's rear face 150, which conductive area 160 conductively communicates with the battery cell negative terminal contact 116 on the circuit board's forward face 156 as previously described. Accordingly, when the circuit of the tape switch 164 is closed upon the application of pressure to the tape switch actuator 170, the battery cell positive terminal 43 is conductively connected to the battery cell negative terminal 45 during such time that actuating pressure is continued to be applied to the tape switch actuator 170.

It should be noted that, like the two switching modes of the tail cap switch 48 permitted by the switch actuator arm 122, the remotely situated tape switch actuator 170 (whether situated under the trigger guard or horseshoed about the front of the handgun grip) may be operated with either of the operator's hands and, in addition, the tape switch actuator 170 may be operated by the same hand used for pulling the handgun's trigger.

Figure 6:
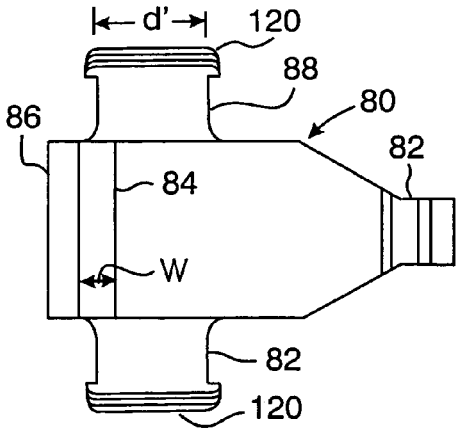
FIG. 6 is a top plan view of a preferred embodiment of a replaceable lever latch plate (in same scale as in FIG. 5) included in the preferred embodiment of the accessory device or light beam generator of FIGS. 2-5.
Figure 7:
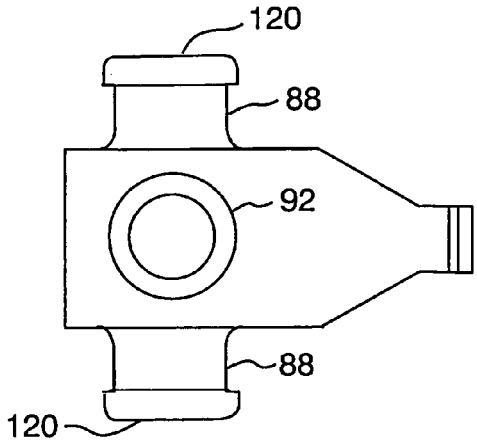
FIG. 7 is a bottom plan view of the lever latch plate of FIG. 6.
Figure 8:
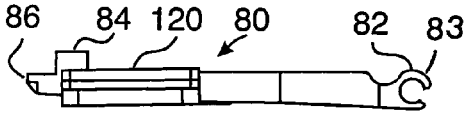
FIG. 8 is a side elevation view of the lever latch plate of FIG. 6.
Figure 10:
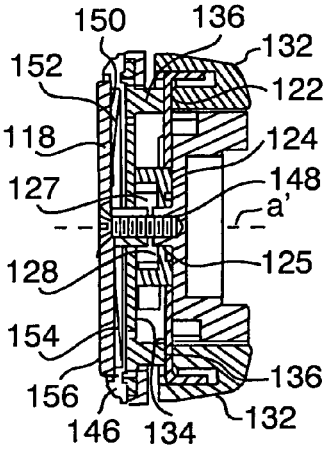
FIG. 10 is a cross-sectional view of the preferred embodiment of a replaceable tail cap switch assembly shown in FIG. 4, taken along a transverse plane along the longitudinal axis a' (the line 10-10 of FIG. 4) and viewed in the direction of the appended arrows.
Figure 9:
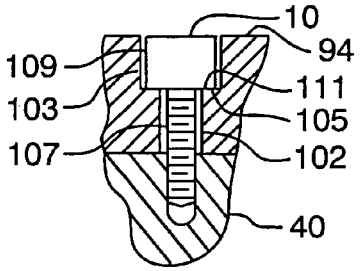
FIG. 9 is a fragmentary, part cross-sectional elevation view of an example of a rail interface member secured to the accessory device housing according to the preferred embodiment.
Figure 11:
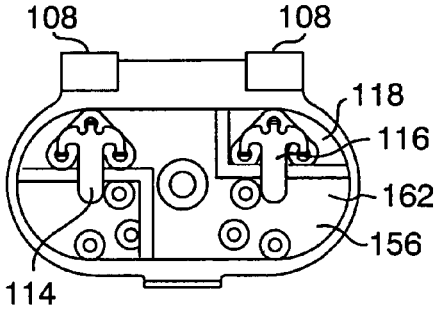
FIG. 11 is a front elevation view of the tail cap switch assembly, which view includes the front surface of the switch circuit board with battery rear terminal contacts.
Figure 12:
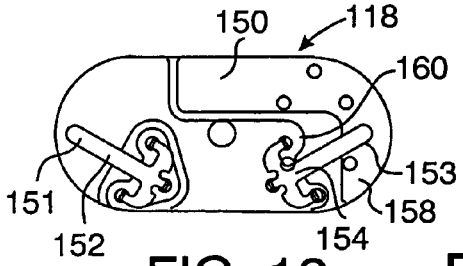
FIG. 12 is a rear view of the tail cap switch assembly circuit board of FIG. 11.
Figure 13:
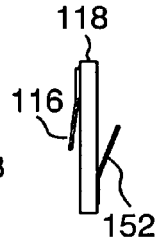
FIG. 13 is a side elevation view of the tail cap switch assembly circuit board of FIGS. 11 and 12.
Figure 14:
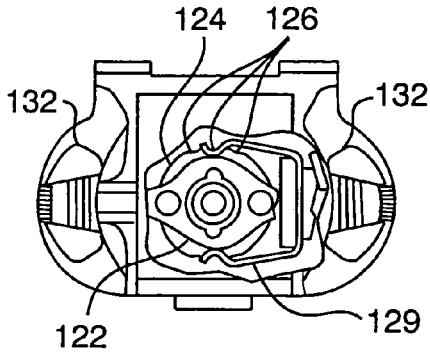
FIG. 14 is a rear elevation view of the tail cap broken away to show structure of a preferred switch actuator mechanism.
Figure 15:
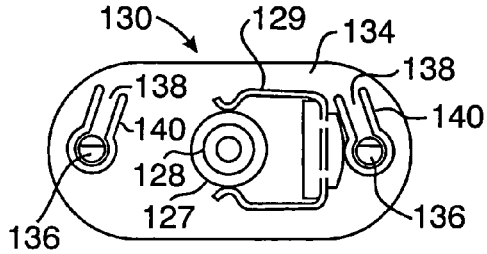
FIG. 15 is a front elevation view of a tail cap insert included in the tail cap switch actuator mechanism.
Figure 16:
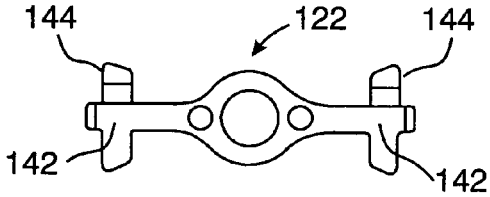
FIG. 16 is a rear elevation view of an actuator arm included in the tail cap switch actuator mechanism.
Figure 17:
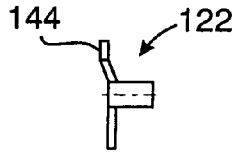
FIG. 17 is a left side view of the actuator arm of FIG. 16.
Figure 20:
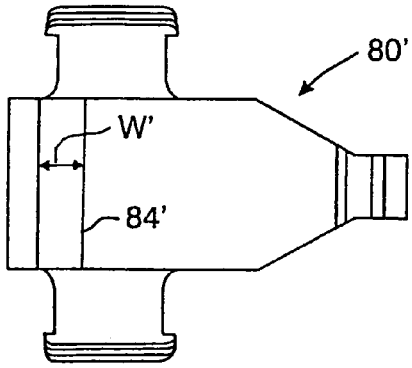
FIG. 20 is a top plan view of a second preferred embodiment of a replaceable lever latch plate included in the preferred embodiment of the accessory device or light beam generator.

It has been noted that the latch plate 80, described in connection with FIG. 6, includes a transversely disposed elongate protuberance 84 having a width w slightly less than the slot 34 of the firearm's rail 30 for being received therein. Different firearm rails may have different slot widths, and indeed two well-known types of rails (namely, a Universal rail and a Picatinny rail) have slots of respectively different standardized widths. In order to accommodate both types of rails, the preferred embodiment of the accessory device 36 of the present invention may be provided with two types of replaceable latch plates. For example, the accessory device 36 may be provided with a latch plate 80 having a protuberance width w of approximately 0.125 inch for accommodating the transverse slot in a Universal rail, while another latch plate 80' (shown in FIG. 20) may be provided having a width w' of its transversely disposed elongate protuberance 84' of approximately 0.205 inch for accommodating the transverse slot of a Picatinny rail. Except for the differences in the width of the transverse protuberance shown as examples of the latch plate 80 and the latch plate 80', the two latch plates 80, 80' are substantially identical and one may be substituted for the other in the accessory device 36 according to the invention.

Accessory devices according to the invention, including the preferred embodiment 36 thereof, may be removably secured to firearms other than handguns, as well as to other types of firearms that do not have integral rails but are adapted for having accessory rail mount system devices secured thereto. Such rail mount system devices are well known in the firearms art, and may be of the type 172 (see FIG. 21) comprising a series of longitudinally spaced-apart ribs 174 separated by transverse slots 176, such as a Picatinny rail specified in MIL-STD-1913 incorporated herein by reference.

Figure 21:
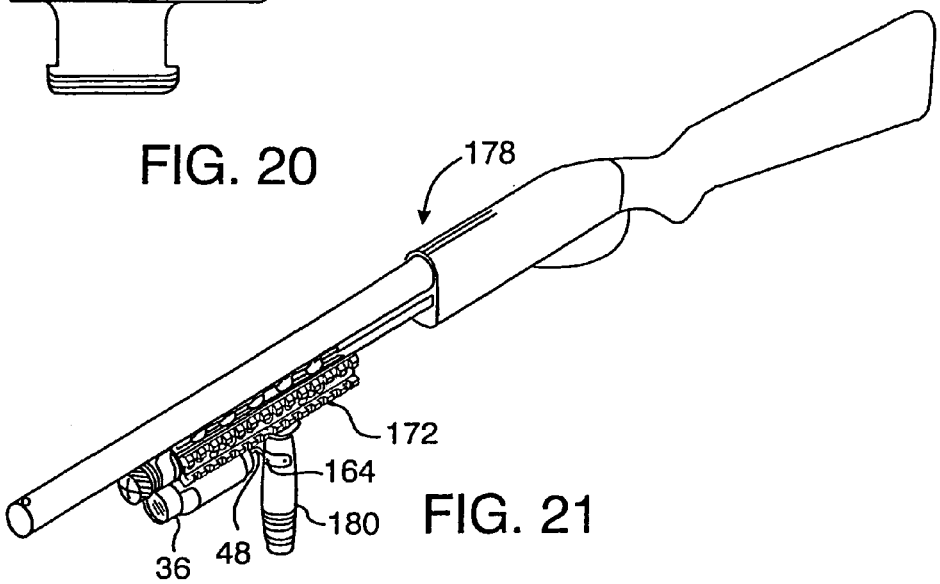
FIG. 21 is a perspective view of a firearm to which is attached a conventional accessory rail mount structure to which is mounted the preferred embodiment of the accessory device or light beam generator of the invention disclosed in the parent application or of the present invention.
Figure 22:
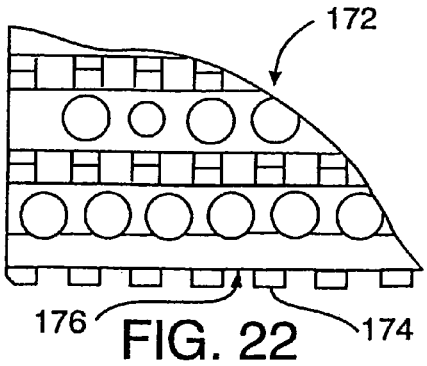
FIG. 22 is a side elevation view of a fragment of the front portion of the accessory rail mount exemplified in FIG. 21.

Such rail mount structures 172 may be secured to long arms, for example to a rifle or shotgun 176 illustrated in FIG. 21 and as further disclosed in U.S. Pat. No. 6,655,069 issued to Paul Y. Kim and incorporated herein by reference. Other examples of rail structures 172, including Picatinny rails, on other types of firearms are disclosed in U.S. Pat. Nos. 6,508,027 and 6,622,416, both issued to Paul Y. Kim and incorporated herein by reference; and in U.S. patent application Ser. No. 10/447,874 of Paul Y. Kim and John W. Matthews, assigned to the assignee of the present invention and incorporated herein by reference.

Figure 23:
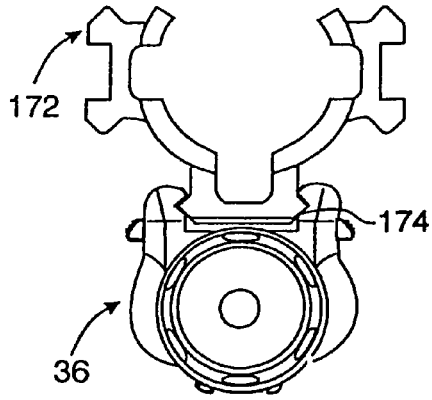
FIG. 23 is a front elevation view of the accessory rail mount of FIG. 22 to which is mounted a light beam generator according to the invention disclosed in the parent application.

As shown in FIGS. 21 and 23, the accessory device or light beam generator 36 may be removably secured to such rail structures 172 secured to firearms other than hand weapons. Where such rail structure 172 is of a type having Picatinny rails, the latch plate 80' shown in FIG. 20 would be installed in the accessory device 36, with the transverse protrusion 34'having a width w' for matingly engaging any one of the Picatinny rail slots 176. The accessory device 36 may be removably secured to the rail structure 172 in substantially the same way as the accessory device 36 may be removably secured to the rail 30 carried by the handgun 20. The operator may adjust the longitudinal position of the accessory device 36 on the rail by depressing the handles 120 until a selected slot 176 has been encountered by the protuberance 34.

As shown in FIG. 21, a handgrip 180 may be secured to the rail structure 172, rearwardly of the light beam generator 36 but in proximity with the tail cap for permitting the operator to conveniently operate the tail cap switch device. In addition, FIG. 21 shows a tape switch 164 connected to the tail cap and having an actuator horseshoed about the front of the handgrip 180. In such configuration, and if both the accessory device 36 and the handgrip 180 are secured to the bottom rail 172 (as illustrated in FIG. 23), the tail cap switch 48 may be actuated in both the CONSTANT ON/OFF and MOMENTARY ON modes with either hand.

The accessory device or light beam generator 36, and in particular the housing 40, elongate members 94, pivot plate 80 and tail cap 50 may be manufactured using fabrication methods well-known in the art, of well known materials typically used in the art of making such components including rigid and durable materials such as polymeric materials as well as light weight aluminum alloys.

Although a target illuminator embodiment of the light beam generator 36 is described above in detail, laser aiming devices securable to rails carried by firearms are included within the scope of light beam generators according to the invention of the parent application.

The preferred embodiment of the enhanced accessory device according to the present invention, specifically the preferred embodiment of a light beam generator 236, is shown with reference to FIGS. 24-41. Turning specifically to FIGS. 27-41 (wherein primed reference numerals indicate components similar to components in FIGS. 4-19 shown with corresponding reference numerals), the enhanced light beam generator 236 includes a housing 240 in which is contained a power source such as a battery 42' of one or more battery cells 44' (for example, two 3-volt lithium battery cells 44') similarly to the power source described above with respect to the light beam generator 36. Also similarly to the light beam generator 36, a light emitter assembly 46' is carried by the enhanced light beam generator housing 240 forwardly of the battery 42' and in circuit with a positive front terminal of one of the battery cells 44' and a negative front terminal of another of the battery cells 44'. The switch device 48' (similar to the switch device 48 previously described) is preferably situated at the rear of the housing 240 in and including a tail cap 50', the switch device 48' including a switch actuator assembly 49' for selectively completing and opening the light emitter energization circuit. In the embodiment shown, this is accomplished by the switch actuator assembly 49' establishing a conductive path between the rear positive terminal 43' of one of the battery cells 44' and the rear negative terminal 45' of the other of the battery cells 44' for placing the switch device 48' in an ON position causing the battery 42' to energize the light emitter assembly 46', and by opening such conductive path for placing the switch in an OFF position where the battery 42' does not energize the light emitter assembly 46'.

The preferred light emitter assembly 46' shown in FIG. 28, as well as alternative embodiments thereof, are described above in connection with the light emitter assembly 46 shown in FIG. 5. Similarly, the structure and operation of the switch device 48' and tail cap 50' of the enhanced light beam generator 236, shown in FIGS. 27 and 28, are described above in connection with the switch device 48 and tail cap 50 shown in FIGS. 4, 5 and 10-19.

Returning to FIGS. 27 and 28, the preferred embodiment of the housing 240 of the light beam generator 236 of the present invention includes a substantially flat upwardly facing or top surface 300 with a rearwardly facing upstanding wall 302 transversely extending along the front edge of the upwardly facing surface 300. Two upstanding first wall segments 304 longitudinally extend forwardly along opposite sides of the top surface 300 from the vicinity of the housing's rear end 306, and two upstanding second wall segments 308 longitudinally extend forwardly of the respective first wall segments 304. The forward generally vertical ends 310 of the respective first wall segments 304 are transversely aligned, and the rearward generally vertical ends 312 of the respective second wall segments 308 are transversely aligned and spaced from the second wall segments' forward ends 310 by a predetermined distance f. The forward generally vertical ends 314 of the respective second wall segments 308 are transversely aligned and spaced from the transverse rearwardly facing upstanding front wall 302 by a predetermined distance g.

A transversely disposed pin 70' is secured to the housing 240 in the vicinity of its rear end 306 and above the housing's top surface 300. The transverse pin 70' is secured to the first wall segments 304 in the vicinity of their rear ends and above the top surface 300. The pin 70' additionally extends through apertures in two upstanding protuberances or partitions 72' from the top surface 300. The two partitions 72' are laterally spaced so as to divide the transverse pin 70' into three exposed segments 74', 76', 78' which may be of substantially equal lengths.

The light beam generator 236 includes a slide latch 316 in cooperative engagement with a slide latch retainer 318 removably secured to the housing 240. Considering FIGS. 29*a*-29*d* along with FIGS. 27 and 28, the slide latch 316 comprises an elongate member or bar 320 with a handle 322 at one end thereof. In a preferred embodiment of the slide latch 316, the bar 320 includes a lower elongate portion 324 extending along substantially the entire length of the bar 320, and an upper elongate portion 326 extending from the vicinity of one end (preferably the handle 322 end) of the bar 320 of lesser length than the lower bar portion 324. The width x (in the longitudinal direction) of the upper bar portion 326 is slightly less than the width of the slot 34 of the firearm's rail for being received therein, and the length of the lower bar portion 324 permits the handle 322 to protrude from its corresponding opening between one of the second wall segments 308 and the housing's rearwardly facing transverse wall 302, while permitting the non-handled end portion 328 of the lower bar portion 324 to extend through and protrude from its corresponding opening between the other one of the second wall segments 308 and the housing's rearwardly facing transverse wall 302 when the latch 316 is in its latched position such as when the upper bar portion 326 is received by the rail slot 34.

The slide latch 316 is provided with an elongate depression or groove 330 of predetermined depth y (in the longitudinal direction) and length l (in the transverse direction), in and along the rearward surface 332 of the lower bar portion 324. The groove 330 has a first end 334 along the lower bar portion 324 near the handle 332 and extends to a second end 336 in the vicinity of the lower bar portion's non-handled end portion 328. A second depression 338 is situated at the first end 334 of the elongate depression or groove 330, the second depression 338 transversely aligned with the groove 330 and being of a predetermined depth z which is greater than the depth y of the groove 330 and of a predetermined length m which is substantially less than the length l of the groove 330.

The preferred embodiment of the slide latch retainer 318 is in the general form of a plate having a generally U-shaped rear end portion 340 configured for receiving the middle segment 76' of the transverse pin 70'. One leg (preferably the upper leg 83') of the U may curve over a portion of the generally rearwardly facing opening of the U, and the retainer is preferably made of material such that the legs are somewhat resilient. As illustrated in FIG. 27, the slide latch retainer 318 is installed to the housing 236 by the user placing the opening of the retainer's rear end portion 340 to the transverse pin segment 76', and the user urging the rear end portion 340 to snap onto the pin segment 76'. The retainer 318 accordingly is hinged at its rear end portion 340 about the transverse hinge pin 70', specifically about the hinge pin segment 76'; i.e., the slide latch retainer 318 is pivotally secured to the housing 240 about a transverse, axis along the pin 70'.

The preferred embodiment of the slide latch retainer 318, shown in FIGS. 31-39, includes a top plate 342 secured to (e.g., integrally formed with or affixed to) a lower frame 344 to which is secured a forwardly biased mechanism 346 for retaining the slide latch 316 to the housing 240. The top plate 342, along with the lower frame 344 and forwardly biased retainer mechanism 346, are configured to fit into the receptacle formed on the housing's upwardly facing flat surface 300, bounded on its longitudinal sides by the wall segments 304, 308 and bounded at its front by the housing's rearwardly facing wall 302. In the preferred embodiment, the top plate 342 is substantially rectangular and the top plate's longitudinal sides 348 snugly fit along the housing side walls 304, 308 when the slide latch retainer 318 is installed to the housing 240 with its rear end 340 secured to the transverse pin 70', and the top plate's transverse front edge 350 is rearwardly spaced from the housing's rearwardly facing front wall 302. When the slide latch retainer 318 is so installed, the top plate 342 is held stationary both longitudinally and transversely with respect to the housing 240.

The forwardly biased retainer mechanism 346 includes an elongate retainer member 352 having a height slightly less than the height j of the elongate depression 330, and having a length slightly less than the combined lengths l plus m of the depressions 330 and 338. The retainer member 352 includes a forward protuberance 354 at one end thereof, the protuberance 354 being of the same height as the retainer member 352 and having a length slightly less than the length m of the second depression 338, the protuberance 354 forwardly extending a distance greater than the depth y of the elongate depression 330 but less than the depth z of the second depression 338. The retainer member 352 is transversely oriented and secured to the frame 344 for longitudinal movement with respect to the frame 344, by a compression spring 356 situated beneath the top plate 342. In the preferred embodiment, the compression spring 356 comprises an elliptically shaped spring with its major diameter transversely oriented, secured to (e.g., integrally formal with or affixed to) the frame 344 and the retainer member 352. The compression spring 356 is rearwardly secured at its minor diameter to the frame 344 and the spring 356 is forwardly secured at its minor diameter to the retainer member 352 at a location substantially midway along the transverse length of the retainer member 352.

Figure 36:
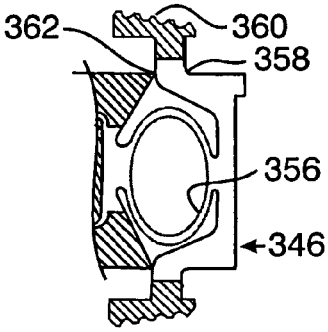
FIG. 36 is the same view of the slide latch retainer fragment as in FIG. 35, but shown actuated for permitting sliding of the slide latch.
Figure 38:
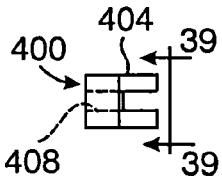
FIG. 38 is a top view of the stabilizer actuator member of FIG. 37.
Figure 39:
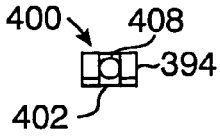
FIG. 39 is an elevational view of the actuator of FIG. 38, viewed along the line 39-39 of FIG. 38 in the direction of the appended arrows.

Lateral arms 358 rearwardly extend from opposite ends of the retainer member 352, the arms 358 thereupon outwardly projecting and terminating with handles 360. When the handles 360 are rearwardly urged by the user, the retainer member 352 is urged rearwardly against the forward bias of the compressed compression spring 356. Such rearward movement of the retainer member 352 is restrained upon the arms 358 being urged into contact engagement with stops 362 on the frame 344 (FIG. 36).

Figure 40:
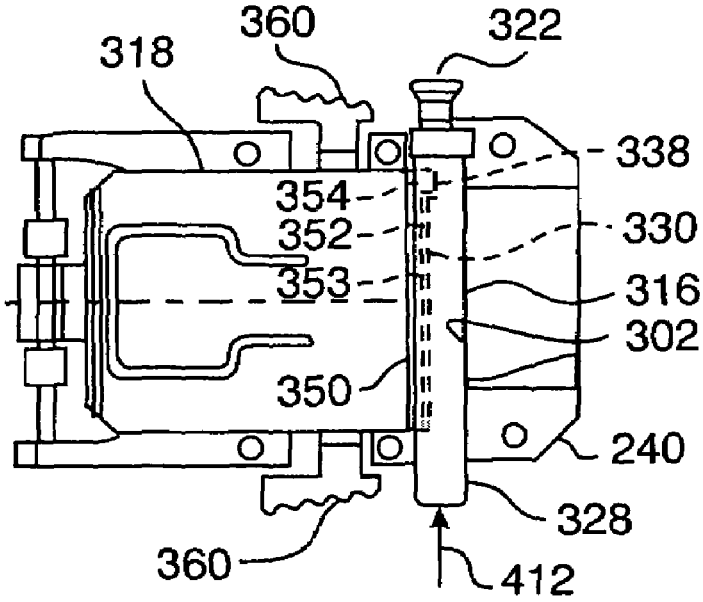
FIG. 40 is a top view of the slide latch and slide latch retainer installed to the battery housing of the accessory device (shown with the elongate rail interface members removed for clarity of description) with the slide latch in its latched position.

The slide latch 316 and slide latch retainer 318 are installed together to the housing 240. In one manner of facilitating such installation, the slide latch retainer 318 is placed to the housing 240 by the user snapping the rear end portion 340 onto the pin segment 76'. The slide latch 316 is placed to the slide latch retainer 318 with the front edge 353 of the retainer member 352 received by the slide latch elongate depression 330 and with the retainer member's forward protrusion 354 received by the slide latch second depression 338 (see also FIG. 27). Such placing of the slide latch 316 to the slide latch retainer 318 may be accomplished either before or after the slide latch retainer 318 is pivotally secured to the transverse pin 70'. In any event, the user holds the slide latch 316 to the retainer member 352 while pivoting the slide latch retainer 318 about the transverse pin 70' toward the housing's top surface 300 (or by pivoting the housing 240 toward the slide latch retainer 318) until the end portions of the slide latch 316 are respectively received by and outwardly extend from the spaces between the housing's rearwardly facing front wall 302 and the two wall segments 308, and with the forward facing surface 325 (FIG. 29*d*) of the slide latch lower bar portion 324 in sliding engagement with the housing's rearwardly facing front wall 302. As shown in FIG. 40, when the slide latch retainer 318 and the slide latch 316 are so installed to the housing 240, the lateral arms 358 outwardly extend through the respective spaces between the wall segments 304 and 308, with the handles 360 respectively protruding therefrom.

Figure 26:
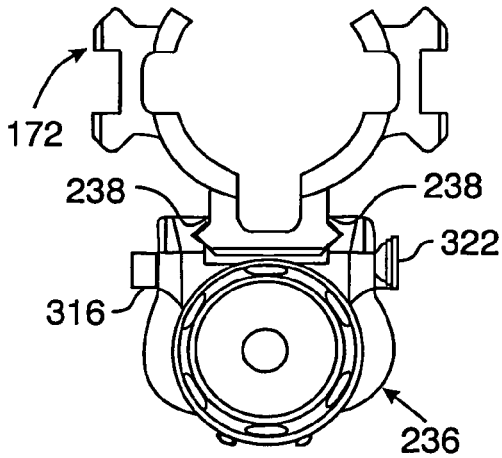
FIG. 26 is a front elevation view of the accessory rail mount of FIG. 22 to which is mounted the light beam generator of FIG. 24.

The accessory device or light beam generator 236 includes two elongate members 294, 295 removably secured to the housing 240, for interfacing with the firearm rail to enable the housing 240 to be retainably slid along the rail 30 (see, in particular, FIGS. 1 and 24-28). Each elongate member 294, 295 includes an inwardly directed tongue 238 longitudinally extending along such member 294, 295; i.e., the elongate rail interface members 294, 295 are installed to the housing 240 with the longitudinal tongue 238 of one of the members 294, 295 facing the longitudinal tongue 238 of the other of the members 294, 295, the tongues 238 complementing the firearm rail's longitudinal grooves 32 for slidably cooperating with the rail's longitudinal grooves 32 while being vertically retained by the rail 30 (or the rail 172) as shown in FIGS. 25 and 26.

The elongate rail interface members 294, 295 are installed to the housing 240 after the slide latch 316 and slide latch retainer 318 have been installed to the housing 240 as previously described. Each member 294, 295 includes a flat bottom surface 296, 297, respectively, for contacting the top surfaces 364, 366 of the first and second wall segments 304, 308 and of the front wall top surfaces 368. The members 294, 295 include bores 370 therethrough aligned with internally threaded blind vertical bores 372 in the wall top surfaces 364, 366, 368, the members 294, 295 being removably secured to the walls by headed screws 374 respectively extending into the bores 370 through the members 294, 295 and threaded into the respectively aligned threaded bores 372 in the housing 240.

The elongate member 295 situated along the side of the housing 240 from which the slide latch handle 322 protrudes includes a transverse cutout 276 therethrough for accommodating the height and longitudinal width of the slide latch upper bar portion 326. It may be appreciated that the installed elongate members 294, 295 vertically capture the lateral arms 358, resulting in the hinged slide latch retainer 318 being restrained against pivoting about the pivot pin 70' and is captured to the housing 240, while the slide latch 316 is both vertically and longitudinally captured to the housing 240. Since the retainer member 352 front edge 353 with its forward protuberance 354 is in receptive engagement with the slide latch 316 elongate depression 330, with the retainer member 352 forward protuberance 354 receptively engaged with the slide latch 316 second depression 338, the slide latch 316 is locked against transverse or sliding movement with respect to the housing 240.

The elongate rail interface members 294, 295 may be removed from the housing 240 by unscrewing the screws 374, and if desired the elongate rail interface members 294, 295 may be replaced by other or different elongate rail interface members which are similarly removably securable to the housing 240. It may be appreciated that when the rail interface members 294, 295 have been removed from the housing 240, the lateral arms 358 of the slide latch retainer 318 and the slide latch 316 itself are no longer upwardly blocked or captured by the members 294, 295, so that the slide latch retainer 318 and slide latch 316 combination may be pivoted about the hinge pin 70' away from the housing top surface 300, freeing the slide latch 316 from the slide latch retainer 318. In such manner, the slide latch 316 may be removed from the housing 240 and another or different slide latch, which is similarly adapted for cooperation with the slide latch retainer 318 and the housing 240, may be placed to the slide latch retainer 318 and installed to the housing 240 as described above.

The slide latch 316 described in connection with FIGS. 29*a-d*, includes an upper bar portion 326 having a width x (in the longitudinal direction) slightly less than the width of the transverse slot 34 of the firearm's rail 30 for being received therein. As previously noted, different firearm rails have different slot widths, including two well-known types of rails (namely, a Universal rail and a Picatinny rail) having slots of respectively different standardized widths. In order to accommodate both types of rails, a preferred embodiment of the accessory device 236 of the present invention may be provided with two types of replaceable slide latches. For example, the accessory device 236 may be provided with a slide latch 316 having a width x of approximately 0.125 inch for accommodating the transverse slot in a Universal rail, while another slide latch 316*a* (see FIGS. 30*a-d*) may be provided having a width x' of its transversely disposed upper bar portion 326*a* of approximately 0.205 inch for accommodating the transverse slot of a Picatinny rail.

In addition to the width differences between the upper bar portions 316 and 316*a*, the height of the upper bar portion 326*a* of the slide latch 316*a* may be greater than the height of the upper bar portion 326 of the slide latch 316. For facilitating accommodation of both types of slide latches 316, 316*a* to the preferred embodiment of the accessory device 236, the cutout 376 of the rail interface member 295 is preferably configured for receiving the extra width and height of the upper bar portion 326*a* of the slide latch 316*a*. Consequently, the preferred embodiment of the slide latch 316 includes a nub 378 upwardly extending along the top thereof in the vicinity of its handled 322 end portion, the nub 378 forwardly extending from the forward facing surface 327 of the upper bar portion 326 in the vicinity of the handled 322 end portion, simulating the height and width of the upper bar portion 326*a* of the slide latch 316*a* at that location. Accordingly, when either one of the slide latches 316 or 316*a* is installed to the housing 240 as shown in FIG. 40, with the two elongate members 294, 295 also secured to the housing 240, the slide latch 316 or 316*a* in the vicinity of its handled end 322 is preferably in sliding engagement with the corresponding surfaces of the cutout 376.

The accessory device 236 is provided with a user adjustable mechanism for assuring vertical stability of the housing 240 with respect to the rail 30 or 172. In the preferred embodiment, the top plate 342 of the slide latch retainer 318 is provided with a resilient tab 380 formed by a cut 382 through the top plate 342, the tab 380 being joined at its base to the top plate 342 along a transverse line 384 (shown in phantom) along which the tab 340 is effectively hinged, the hinge line 384 being rearwardly spaced from the retainer member 352. The rearwardly disposed free end 386 of the tab 380 is further rearwardly spaced from the retainer member 352 (and hence from the latch 316 when installed).

As shown in FIGS. 31-33 and 37-39, the underside of the tab 380 is configured with a compartment 388 formed by two longitudinally spaced-apart transverse walls 390 depending from the tab 388 and a longitudinal depending wall 392 having an upwardly inclined inner surface 394. The longitudinal wall 392 includes a transverse channel 396 extending through the inclined surface 394 and aligned with a transverse bore 398 in the frame 344. A preferably rigid actuator member 400 (fabricated, for example, of stainless steel) has a bottom surface 402 for slidably engaging the housing's top surface 300, and an inclined surface 404 complementary to and contacting the tab compartment's inclined surface 394 when the actuator's bottom surface 402 engages the housing's top surface 300. The actuator 400 includes a threaded transverse bore 408 therethrough, for threaded engagement with a transversely disposed headed screw 406 extending through a transverse bore 410 in the wall 304 of the housing 240 and through the frame's bore 398 and the compartment's transverse channel 396 (with the head of the screw 406 being retained to the housing 240 by the counterbored bore 410).

It may be appreciated that, as the user fastens the head-retained screw 406 into the threaded bore 408 of the actuator 400, the actuator 400 is caused to slide transversely along the housing top surface 300 (to the right as viewed in FIG. 37), causing the actuator's inclined surface 404 to be slidably urged against the tab's inclined surface 394. Such action urges the tab 380 to flexibly pivot about the transverse hinge line 384 and the tab's free end 386 to move upwardly into contact engagement with the bottom surface 35 of the rail 30.

Any gap between the housing 240 and the bottom 35 of the rail 30 is thereby filled at a location longitudinally spaced from the engagement of the slide latch 316 in the rail slot 34, by such engagement of the tab 380 against the bottom surface 35 of the rail 30, it being recognized that the tab 380 is vertically supported by the actuator member 400 in contact engagement with and between the underside of the tab 380 and the top surface 300 of the housing 240. Accordingly, by filling a gap (if any) longitudinally spaced from the latch 316, between the housing 240 and the bottom of the rail 30, the housing 240 supportively engages the bottom of the rail 30, resulting in enhanced vertical stability of the accessory device 236 with respect to the rail 30.

The adjustment for placing the tab 380 in contact with the rail 30 may be performed when a particular accessory device 236 is initially mounted to a particular rail 30 or 172. Readjustment should generally not be required during subsequent installations of the same accessory device 236 to the same rail 30 or 172, provided that the initial adjustment has not been changed.

The actuator member 400 may be installed to the housing 240 at the same time the slide latch retainer 318 is installed to the housing 240. For example, the actuator member 400 may be placed in the cavity 388 with the slide latch retainer 318 positioned underside up, the latch retainer 318 having been pivotally secured to the housing's transverse pin 70' with the slide latch 316 in place. The housing 240 may thereupon be pivoted about the transverse axis of the pivot pin 70', for engaging the slide latch retainer 318/slide latch 316 combination with the housing 240 as previously discussed. The screw 406 is thereupon inserted in the housing wall bore 410 and is caused to threadably engage the threaded bore of the actuator member 400.

FIG. 40 illustrates the position of the slide latch 316 as placed to the slide latch retainer 318 and installed to the housing 240, with the front surface 325 of the lower bar portion 324 in transverse sliding engagement with the housing's rearwardly facing wall 302 and with the rearward surface 332 of the lower bar portion 324 in transverse sliding engagement with the longitudinally and transversely stationary transverse front edge 350 of the slide latch retainer top plate 342. As previously described, the front edge 353 of the elongate retainer member 352 is received by the elongate depression or groove 330 in the slide latch 316, with the retainer member's forward protuberance 354 received by the slide latch second depression 338. Assembly of the light beam generator 236 is completed upon securing the elongate members 294, 295 to the housing 240 and securing the tail cap switch device 48' to the pivot pin 70', as previously described.

Figure 41:
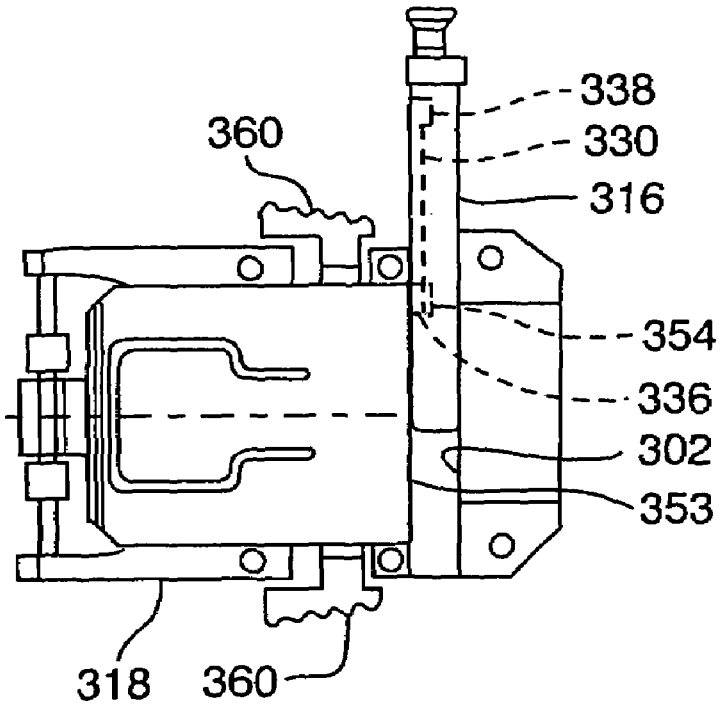
FIG. 41 is the same view as in FIG. 41, with the slide latch in its unlatched position.

When it is desired to install the light beam generator 236 to the rail 30, the user causes the slide latch 316 to transversely slide from its latched position shown in FIG. 40 to its unlatched but retained position shown in FIG. 41. This is accomplished by the user urging the handles 360 (and hence the retainer member 352) rearwardly, against the forward bias of the compression spring 356, to longitudinally withdraw the forward protuberance 354 of the elongate retainer member 352 from the slide latch's second depression 338 such that the elongate depression 330 is transversely accessible to the protuberance 354. For example, if the longitudinal length of the protuberance 354 is substantially equal to the difference between the depth z (see FIG. 29*b*) of the second depression and the depth y of the groove 330 (i.e., z−y), the withdrawal distance would be a distance greater than such difference (z−y) but less than the depth z of the second depression, which withdrawal distance is assured by the stops 362 (see FIGS. 35 and 36).

The user thereupon transversely pushes the non-handled end portion 328 of the slide latch 316 inwardly (in the direction of the arrow 412, FIG. 40) while releasing the handles 360, and then transversely pulls the handle 322 (outwardly, in the same direction as the arrow 412). Accordingly, the lower bar portion 324 of the slide latch 316 is caused to transversely slide along the housing's rearwardly facing front wall 302 and the top plate front edge 350 of the slide latch retainer 318, with the forward protuberance 354 of the retainer member 352 received by the elongate depression or groove 330. The user continues such pulling of the handle 322 until the second end 336 of the elongate depression 330 contacts the retainer member forward protuberance 354, whereupon further outwardly transverse movement of the slide latch 316 is prevented and the slide latch is retained to the housing 240. This second or unlatched position of the slide latch 316 is shown in FIG. 41.

With the slide latch 316 in such unlatched position, the light beam generator 236 is placed to the firearm rail 30 with the rear ends of the tongues 238 of the rail interface members 294, 295 respectively engaging the forward ends of the grooves 32 of the rail 30. The upper bar portion 326 of the slide latch 316, when in this second position, is situated entirely outwardly of the rail 30, and the user rearwardly urges the light beam generator 236 for sliding the housing 240 along the rail 30 while the housing 240 is being vertically retained by the rail 30. When the transverse slide latch 316 is aligned with the transverse slot 34 of the rail 30, the user pushes the handle 322 of the slide latch 316 inwardly (i.e. the user transversely urges the slide latch 316 opposite the direction indicated by the arrow 412), causing the upper bar portion 326 of the slide latch 316 to transversely enter the slot 34. The user continues such transverse urging of the slide latch 316 until the forward protuberance 354 of the forwardly biased retainer member 352 (which, as described above, is received by the elongate depression or groove 330) is longitudinally aligned with the second depression 338 whereupon the front edge 353 of the forwardly biased retainer member 352 is received by the groove 330 with the protuberance 354 received by the second depression 338. Accordingly, the slide latch 316 is locked in this first or latched position (shown in FIG. 40) with the slide latch's upper bar portion 326 situated within the transverse slot 34 of the rail 30.

As earlier noted, the width of the upper bar portion 326 is slightly less than the width of the slot 34 such that the upper bar portion 326 just fits into the slot 34. The engagement of the upper bar portion 327 with the slot 34, as well as the engagement of the lower bar portion 325 with the housing's rearwardly facing surface 302 and the slide latch retainer 318, longitudinally latching the housing 240 to the rail 30 in a manner preventing longitudinal movement of the accessory device 236 with respect to the rail 30, which may be caused, for example, upon discharge of the firearm.

The longitudinal positions of the slot 34 and of the slide latch 316 are preferably predetermined such that the rear end of the tail cap 50' is situated just forwardly of, or even contacting, the handgun's trigger guard 26 when the slide latch 316 engages the slot 34. The user may then adjust the vertical position of the tab 380 for placing the tab 380 in contact with the bottom surface 35 of the rail 30 as previously described, as may be appropriate for preventing vertical movement of the accessory device 236 with respect to the rail 30 which may be caused, for example, upon discharge of the firearm.

To remove the accessory device 236 from the rail 30, the user rearwardly urges the handles 360 (and hence the retainer member 352) against the bias of the compression spring 356, thereby rearwardly urging the elongate retainer member 352 for withdrawing the forward protuberance 354 from the second depression 338 for transverse accessibility to the groove 330. The user then transversely urges the slide latch 316 in the direction of the arrow 412, as previously described, until the slide latch 316 is in its second or unlatched position as shown in FIG. 41. The user thereupon forwardly urges the accessory device 236 to slide along the rail 30 until the accessory device 236 is removed therefrom.

The rail interface members 294, 295 may be configured to accommodate differences in the dimensional tolerances of firearm rails 30 manufactured by different manufacturers, and even among firearm rails manufactured by the same manufacturer. In a preferred embodiment of the rail interface members 294, 295 for accommodating such differences, the bores 370 and counterbores in the rail interface members 294, 295 may be configured similarly as the bores 102 and the counterbores 103 in the rail interface members 94 as previously described (see FIG. 9). During installation of the light beam generator 236 to a particular firearm rail 30, if the engagement of the rail interface members 294, 295 to the rail 30 is too loose, the user may simply loosen the screws 374, move the rail interface members 294, 295 inwardly (transversely toward each other) and thereupon tighten the screws 374. If the engagement between the rail interface members 294, 295 and the rail 30 is too tight, the user may loosen the screws 374, move the rail interface members 294, 295 outwardly (transversely away from each other) and tighten the screws 374. In either event, the adjustment assists in the prevention of transverse movement of the accessory device 236 with respect to the rail 30 which may be caused, for example, upon discharge of the firearm.

The accessory device or light beam generator 236 may be manufactured using fabrication methods well-known in the art, of well-known materials typically used in the art of making such components including rigid and durable materials such as polymeric materials as well as lightweight aluminum alloys, and resilient materials such as nylon materials. In the preferred embodiment of the light beam generator 236, the housing 240 may be fabricated of an aluminum alloy; the slide latch 316, the slide latch retainer 318 and the elongate members 294, 295 may be fabricated of a nylon material; and the actuator member 400 may be fabricated of stainless steel.

Although a target illuminator embodiment of the light beam generator 236 is described above in detail, laser aiming devices securable to rails carried by firearms are included within the scope of light beam generators according to the present invention.

Thus, there has been described a preferred embodiment of an enhanced stability accessory device which is removably securable to a longitudinal rail carried by a firearm, which accommodates longitudinal rails of different configurations carried by firearms, and which includes a removably securable transverse latching device. The light beam generator of the preferred embodiment includes a removable tail cap switch actuable by either hand of an operator for placing the switch in CONSTANT ON/OFF positions and in a MOMENTARY ON position, as well as for remote actuation by either hand to a MOMENTARY ON position. Other embodiments of the present invention, and variations of the embodiments presented herein, may be developed without departing from the essential characteristics thereof. Accordingly, the invention should be limited only by the scope of the claims listed below.

We claim:

1. An accessory device for a firearm including a longitudinal barrel, a longitudinal rail carried by the firearm, and a transverse slot in the rail, the accessory device comprising:

a housing having a top surface;

elongate rail interface members along said housing complementing the rail for enabling said housing to be retainably slid along the rail with said top surface facing the rail;

an elongate latch carried by said housing and transversely slidable along said top surface when said latch is transversely aligned with the slot, from an unlatched position disengaged from the slot to a latched position engaging the slot; and a latch retainer carried by said housing transversely locking said elongate latch when in said latched position, said latch retainer adapted for being manipulated by a user for unlocking said elongate latch from said latched position and for permitting said elongate latch to be transversely urged by the user to said unlatched position with said elongate latch transversely retained to said housing.

2. The accessory device according to claim 1, wherein:

said elongate rail interface members are removably secured to said housing.

3. The accessory device according to claim 1, wherein:

said elongate latch extends through an opening in a side of said housing; and said latch retainer and said latch are adapted for preventing transverse withdrawal of said latch through said opening when said latch is in said unlatched position.

4. The accessory device according to claim 1, including:

an adjustable device carried by said housing and longitudinally spaced from said latch, said adjustable device adapted for supportively engaging said housing to the rail.

5. The accessory device according to claim 1, wherein:

said housing includes a transverse wall along said top surface; and said latch is interposed between said wall and said latch retainer.

6. The accessory device according to claim 5, wherein:

said latch is restrained against longitudinal movement along said housing by said wall and said latch retainer.

7. The accessory device according to claim 1, wherein:

said latch extends through respective openings in opposing longitudinal sides of said housing.

8. The accessory device according to claim 7, wherein:

said elongate rail interface members are removably secured along said opposing longitudinal sides including said openings for restraining said latch from movement normal to the top surface of said housing.

9. The accessory device according to claim 1, including:

an elongate depression in said latch for cooperating with said latch retainer for guiding said latch when said latch is transversely urged.

10. The accessory device according to claim 1, wherein:

said latch retainer is removably secured to said housing.

11. The accessory device according to claim 1, wherein:

said latch retainer is pivotally secured to said housing about a transverse axis.

12. The accessory device according to claim 11, wherein:

said elongate rail interface members are removably secured along opposing longitudinal sides of said housing; and said latch retainer is pivotally restrained to said housing by said elongate rail interface members when said elongate rail interface members are secured to said housing.

13. The accessory device according to claim 12, wherein:

said latch retainer is removable from its securement about said transverse axis when said elongate rail interface members are removed from said housing.

14. The accessory device according to claim 2, wherein:

the securement of said elongate rail interface members to said housing is transversely adjustable.

15. The accessory device according to claim 2, wherein:

said elongate rail interface members are secured to said housing with headed screws retained in bores in said elongate rail interface members respectively communicating with threaded bores in said housing, said bores in said elongate rail interface members providing a loose fit with said headed screws at least in the transverse direction for adjusting the transverse distance between said members.

16. The accessory device according to claim 1, including:

a light emitter assembly carried by said housing;

a battery carried by said housing in circuit for energizing said light emitter assembly when switch actuated; and a switch device including a switch actuator for said battery.

17. The accessory device according to claim 16, wherein:

said switch device is removably secured to said housing.

18. The accessory device according to claim 16, wherein:

said switch actuator is rotatably urgeable by either hand of a user when said housing is installed on the rail for placing said switch device in a CONSTANT ON or OFF position, and forwardly urgeable by either hand of the user when said housing is installed on the rail for placing said switch device in a MOMENTARY ON position.

19. The accessory device according to claim 18, including:

a remote switch actuator communicating with said switch device for remotely actuating said switch device to a MOMENTARY ON position.

20. The accessory device according to claim 16, wherein:

said switch device comprises a tail cap switch pivotally secured to said housing about a pivot axis.

21. The accessory device according to claim 20, wherein:

said tail cap switch is adapted for being removed by a user from its securement about said pivot axis.

22. The accessory device according to claim 20, wherein:

said tail cap switch is adapted for being removed by a user from its securement about said pivot axis only when said tail cap switch is pivoted away from said housing.

23. The accessory device according to claim 20, wherein:

said tail cap switch includes a switch actuator rotatably urgeable by either hand of a user when said housing is installed on the rail for placing said tail cap switch in a CONSTANT ON or OFF position, and axially urgeable by either hand of the user when said housing is installed on the rail for placing said tail cap switch in a MOMENTARY ON position.

24. The accessory device according to claim 23, including:

a remote switch actuator communicating with said tail cap switch and operable by either hand of the user for placing said tail cap switch in a MOMENTARY ON position.

25. The accessory device according to claim 16, wherein:

said switch device comprises a tail cap switch and said switch actuator includes an actuator arm rotable at its center about a longitudinal axis of said housing, said actuator arm including longitudinally displaceable ends with handles at said ends, one of said handles accessible to one hand of a user and the other of said handles accessible to the other hand of the user when said housing is installed on the rail;

said switch actuator is adapted for placing said tail cap switch in a CONSTANT ON position when either of said handles is upwardly or downwardly urged by the user from an OFF position of said switch, and for returning said tail cap switch to the OFF position upon reverse urging of either of said handles; and said switch actuator is adapted for placing said switch in a MOMENTARY ON position when either of said handles is forwardly urged from the OFF position by the user.

26. The accessory device according to claim 25, wherein: said switch actuator is latched in the OFF position when said actuator arm is transversely oriented, and said switch actuator is latched in the CONSTANT ON position when said actuator arm is rotationally displaced from its transverse orientation.

27. The accessory device according to claim 25, wherein: said tail cap switch is pivotally secured to said housing about a pivot axis.

28. The accessory device according to claim 27, wherein: said tail cap switch is adapted for being removed by a user from its securement about said pivot axis.

29. An accessory device for a firearm including a longitudinal barrel, a longitudinal rail carried by the firearm, and a transverse slot in the rail, the accessory device comprising:

a housing having a top surface and an upstanding wall transversely extending along said top surface;

elongate rail interface members along said housing complementing the rail for enabling said housing to be longitudinally slid along the rail;

a bar transversely carried by said housing, said bar including an upper portion for being transversely received by the slot, said bar including a lower portion having a first surface in transverse sliding engagement with said wall and a second surface opposite said first surface including an elongate depression terminating at a first end with a second depression of depth greater than the depth of said elongate depression, said elongate depression terminating at a second end;

a retainer for said bar, said retainer secured to said housing and having a transverse edge portion including a longitudinally extending protuberance, said edge portion received by said elongate depression with said protuberance received by said second depression for preventing sliding of said bar along said wall, said retainer adapted for being manipulated by a user for longitudinally urging said edge portion from said elongate depression and said protuberance from said second depression whereupon said bar is transversely slidable along said wall with said protuberance captured within said elongate depression.

30. The accessory device according to claim 29, wherein:

said first surface comprises a front surface;

said second surface comprises a rear surface;

said transverse edge portion comprises a front edge portion;

said longitudinally extending protuberance comprises a forwardly extending protuberance; and said longitudinally urging of said edge portion comprises a rearwardly urging of said edge portion.

31. The accessory device according to claim 30, wherein: said retainer includes a forwardly biased elongate member having said front edge portion.

32. The accessory device according to claim 31, wherein: said retainer includes a frame secured to said housing and a compression spring longitudinally securing said elongate member to said frame.

33. The accessory device according to claim 32, wherein: said retainer includes a top plate secured to said frame and having a transverse front edge longitudinally spaced from said wall.

34. The accessory device according to claim 33, including:

a tab provided in said top plate; and an actuator interposed between said top surface of said housing and said tab and operable by a user for causing said tab to contact the bottom surface of the rail.

35. The accessory device according to claim 29, including:

an adjustable device carried by said housing and longitudinally spaced from said bar, said adjustable device being adjustable for supportively engaging said housing to the rail.

36. The accessory device according to claim 29, wherein: said retainer is pivotally secured to said housing about a transverse axis.

37. The accessory device according to claim 31, wherein: said forwardly biased elongate member includes lateral arms extending through said housing and rearwardly urgeable by a user for rearwardly displacing said forwardly biased elongate member.

38. The accessory device according to claim 29, wherein: said elongate rail interface members are removably secured to said housing.

39. The accessory device according to claim 38, wherein: said retainer is removably secured to said housing.

40. The accessory device according to claim 38, wherein: said retainer is pivotally secured to said housing about a transverse axis.

41. The accessory device according to claim 40, wherein: said retainer is pivotally restrained to said housing by said elongate rail interface members when said elongate rail interface members are secured to said housing.

42. The accessory device according to claim 41, wherein: said retainer is removable from its securement about said transverse axis when said elongate rail interface members are removed from said housing.

43. The accessory device according to claim 38, wherein: the securement of said elongate rail interface members to said housing is transversely adjustable.

44. The accessory device according to claim 43, wherein: said elongate rail interface members are secured to said housing with headed screws retained in bores in said elongate rail interface members respectively communicating with threaded bores in said housing, said bores in said elongate rail interface members providing a loose fit with said headed screws at least in the transverse direction for adjusting the transverse distance between said elongate rail interface members.

45. The accessory device according to claim 38, wherein: said elongate rail interface members restrain movement of said bar normal to said top surface when said elongate rail interface members are secured to said housing.

46. The accessory device according to claim 45, wherein: said bar is removable from said housing when said elongate rail interface members are removed from said housing.

47. The accessory device according to claim 29, including:

a light emitter assembly carried by said housing;

a battery carried by said housing in circuit for energizing said light emitter assembly when switch actuated; and a switch device including a switch actuator for said battery.

48. The accessory device according to claim 47, wherein: said switch device is removably secured to said housing.

49. The accessory device according to claim 47, wherein: said switch actuator is rotatably urgeable by either hand of a user when said housing is installed on the rail for placing said switch device in a CONSTANT ON or OFF position, and longitudinally urgeable by either hand of the user when said housing is installed on the rail for placing said switch device in a MOMENTARY ON position.

50. The accessory device according to claim 49, including:

a remote switch actuator communicating with said switch device for remotely actuating said switch device to a MOMENTARY ON position.

51. The accessory device according to claim 47, wherein:

said switch device comprises a tail cap switch pivotally secured to said housing about a pivot axis.

52. The accessory device according to claim 51, wherein:

said tail cap switch is adapted for being removed by a user from its securement about said pivot axis.

53. The accessory device according to claim 51, wherein:

said tail cap switch is adapted for being removed by a user from its securement about said pivot axis only when said tail cap switch is pivoted away from said housing.

54. A method of assembling an accessory device for installation on a longitudinal rail having a transverse slot therein, comprising:

providing the accessory device including a housing having a top surface and a transverse wall along said top surface;

providing elongate rail interface members complementing the rail;

providing an elongate latch member sized for being slidably received by the slot in the rail;

providing a latch retainer having a forwardly biased front edge portion;

placing said latch member to said front edge portion of said latch retainer;

securing said latch retainer to said housing with said latch member interposed between said wall and said forwardly biased edge portion of said latch retainer; and removably securing said elongate rail interface members to said housing with said elongate rail interface members capturing said latch retainer and said latch member to said housing.

55. The method according to claim 54, further including:

sliding said latch member transversely along said top surface of said housing to an unlatched position;

sliding said housing longitudinally along the rail until said latch member is transversely aligned with the slot in the rail; and sliding said latch member transversely for being received by the slot.

56. The method according to claim 55, further including:

causing said housing to engage the bottom of the rail at a location longitudinally spaced from said latch member.

57. The method according to claim 54, wherein:

in the latch retainer providing step, said latch retainer is removably securable to said housing about a transverse axis.

58. The method according to claim 54, wherein:

in the latch member providing step, said latch member includes an elongate depression; and in the latch member placing step, said forwardly biased front edge portion of said latch retainer is received by said elongate depression of said latch member.

59. The method according to claim 54, wherein:

in the latch member providing step, said latch member includes an elongate depression terminating with a second depression of greater depth;

in the latch retainer providing step, said forwardly biased front edge portion includes a forwardly extending protrusion; and in the latch member placing step, said forwardly biased front edge portion of said latch retainer is received by said elongate depression of said latch member with said protrusion received by said second depression.

60. The method according to claim 59, further including:

rearwardly urging said forwardly biased front edge portion of said latch retainer for urging said edge portion from said elongate depression and said protuberance from said second depression for permitting transverse sliding of said latch member with said protuberance captured within said elongate depression;

sliding said latch member transversely along said top surface of said housing to an unlatched position;

sliding said housing longitudinally along the rail until said latch member is transversely aligned with the slot in the rail; and sliding said latch member transversely for being received by the slot.

61. The method according to claim 60, further including:

rearwardly urging said forwardly biased front edge portion of said latch retainer for urging said edge portion from said elongate depression and said protuberance from said second depression such that said latch member is transversely slidable with said protrusion captured within said elongate depression;

sliding said latch member transversely along said top surface of said housing to an unlatched position; and sliding said housing longitudinally along the rail until said housing is removed therefrom.

62. The method according to claim 54 wherein the rail is a first rail, further including:

removing said elongate rail interface members from said housing;

removing said latch member from said housing;

providing a second latch member sized for being slidingly received by a slot in a second rail carried by a firearm;

placing said second latch member to said front edge portion of said latch retainer with said latch member disposed for being transversely slid along the top surface of said housing; and removably securing said elongate rail interface members to said housing with said elongate rail interface members capturing said latch retainer and said second latch member to said housing.

63. The method according to claim 62, wherein:

in the second latch member providing step, said second latch member is of a different width than said first latch member.

64. The method according to claim 54, wherein:

in the latch retainer securing step, pivotally securing said latch retainer to said housing and pivoting said latch retainer with said latch member placed thereto toward said top surface of said housing.

65. The method according to claim 64, further including:

removing said elongate rail interface members from said housing;

pivoting said latch retainer with said latch member away from said top surface;

removing said latch member from its placement to said latch retainer;

providing a second latch member sized for being slidably received by a slot in a second rail carried by a firearm;

placing said second latch member to said front edge portion of said latch retainer;

pivoting said latch retainer with said latch member toward said top surface; and removably securing said elongate rail interface members to said housing with said elongate rail interface members capturing said latch retainer and said latch member to said housing.

66. The method according to claim 65, wherein:

in the second latch member providing step, said second latch member is of a different width than the removed latch member.

* * * * *